US010074464B2

(12) United States Patent
Naka et al.

(10) Patent No.: US 10,074,464 B2
(45) Date of Patent: Sep. 11, 2018

(54) CHIP RESISTOR AND MANUFACTURING METHOD THEREOF

(71) Applicant: ROHM CO., LTD., Kyoto (JP)

(72) Inventors: Kentaro Naka, Kyoto (JP); Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 54 days.

(21) Appl. No.: 15/161,744

(22) Filed: May 23, 2016

(65) Prior Publication Data

US 2016/0343480 A1 Nov. 24, 2016

(30) Foreign Application Priority Data

May 21, 2015 (JP) ..... 2015-103785

(51) Int. Cl.
*H01C 1/148* (2006.01)
*H01C 17/00* (2006.01)
*H01C 17/28* (2006.01)

(52) U.S. Cl.
CPC ..... *H01C 1/148* (2013.01); *H01C 17/006* (2013.01); *H01C 17/281* (2013.01)

(58) Field of Classification Search
USPC ..... 338/309, 332
See application file for complete search history.

(56) References Cited

U.S. PATENT DOCUMENTS 7,129,814 B2 * 10/2006 Tsukada ..... H01C 1/148 338/309
8,058,968 B2 * 11/2011 Hirano ..... H01C 17/245 338/309
8,686,828 B2 * 4/2014 Smith ..... H01C 1/142 338/254
2005/0035844 A1 * 2/2005 Tsukada ..... H01C 1/148 338/309
2006/0097340 A1 * 5/2006 Tsukda ..... H01C 1/144 257/516
2007/0018782 A1 * 1/2007 Tsukada ..... H01C 1/148 338/309
2007/0132545 A1 * 6/2007 Tsukada ..... H01C 1/144 338/309

FOREIGN PATENT DOCUMENTS

JP 11162720 6/1999
JP 3846987 9/2006

* cited by examiner

*Primary Examiner* — Kyung Lee
(74) *Attorney, Agent, or Firm* — Hamre, Schumann, Mueller & Larson, P.C.

(57) ABSTRACT

There is provided a chip resistor suitable for power detection. The chip resistor includes a resistor having a resistor lower surface and a resistor upper surface which face mutually opposite sides in a thickness direction, a pair of resistor first side surfaces spaced apart from each other in a first direction perpendicular to the thickness direction, and a pair of resistor second side surfaces spaced apart from each other in a second direction perpendicular to both the thickness direction and the first direction, a first electrode formed along one resistor first side surface, and a second electrode formed along the other resistor first side surface, and spaced apart from the first electrode.

28 Claims, 20 Drawing Sheets

CHIP RESISTOR AND MANUFACTURING METHOD THEREOF

CROSS-REFERENCE TO RELATED APPLICATION(S)

This application is based upon and claims the benefit of priority from Japanese Patent Application No. 2015-103785, filed on May 21, 2015, the entire contents of which are incorporated herein by reference.

TECHNICAL FIELD

The present disclosure relates to a chip resistor using a metal plate resistor suitable for power detection, among chip resistors, and a manufacturing method thereof.

BACKGROUND

A chip resistor using a metal plate resistor formed of a Ni—Cr alloy or the like has been widely known as, for example, a shunt resistor suitable for detecting a current. A resistance value of the chip resistor ranges from about 0.2 to 3.0 mΩ, which is very low. Recently, miniaturization of a chip resistor that uses a metal plate resistor is required.

For example, a chip resistor using a metal plate resistor has been employed in the related art. In the chip resistor, a pair of electrodes is bonded to both ends of the metal plate resistor formed of a Ni—Cr alloy or the like through spot welding, and the metal plate resistor is covered with a protective film formed of a synthetic resin having heat resistance and electrical insulation properties. The pair of electrodes is formed from a metal plate formed of Cu and having a surface plated with solder. Since the metal electrodes are bonded to both ends of the metal plate resistor through spot welding in the chip resistor, when the chip resistor is miniaturized, there is a problem in that it is difficult to perform spot welding.

SUMMARY

The present disclosure provides some embodiments of a chip resistor using a metal plate resistor capable of reducing size.

According to a first embodiment of the present disclosure, there is provided a chip resistor, including: a resistor having a resistor lower surface and a resistor upper surface which face mutually opposite sides in a thickness direction, a pair of resistor first side surfaces spaced apart from each other in a first direction perpendicular to the thickness direction, and a pair of resistor second side surfaces spaced apart from each other in a second direction perpendicular to both the thickness direction and the first direction; a first electrode formed along one resistor first side surface; and a second electrode formed along the other resistor first side surface, and spaced apart from the first electrode, wherein the first electrode and the second electrode are electrically connected with the resistor by covering a portion of the resistor lower surface and the resistor first side surfaces, respectively, the first electrode has a first electrode lower end edge that is in contact with the resistor lower surface, the second electrode has a second electrode lower end edge that is in contact with the resistor lower surface, both the first electrode lower end edge and the second electrode lower end edge in the resistor lower surface are continuously formed to extend from one resistor second side surface to the other resistor second side surface, and steps are formed by the first electrode lower end edge and the second electrode lower end edge, respectively.

In an embodiment of the present disclosure, a portion of the resistor lower surface sandwiched between the first electrode lower end edge and the second electrode lower end edge is exposed.

In an embodiment of the present disclosure, the resistor second side surface is flush with a portion of each of the first electrode and the second electrode which face in the second direction.

In an embodiment of the present disclosure, both the first electrode lower end edge and the second electrode lower end edge are parallel to the second direction.

In an embodiment of the present disclosure, the resistor upper surface is entirely exposed.

In an embodiment of the present disclosure, both the first electrode and the second electrode have a portion that covers a portion of the resistor upper surface.

In an embodiment of the present disclosure, the first electrode has a first electrode upper end edge that is in contact with the resistor upper surface and the second electrode has a second electrode upper end edge that is in contact with the resistor upper surface.

In an embodiment of the present disclosure, a portion of the resistor upper surface sandwiched between the first electrode upper end edge and the second electrode upper end edge is exposed.

In an embodiment of the present disclosure, both the first electrode upper end edge and the second electrode upper end edge are continuously formed to extend from one resistor second side surface to the other resistor second side surface in the resistor upper surface.

In an embodiment of the present disclosure, both the first electrode upper end edge and the second electrode upper end edge are parallel to the second direction.

In an embodiment of the present disclosure, an exposed area of the portion of the resistor upper surface sandwiched between the first electrode upper end edge and the second electrode upper end edge is wider than that of the portion of the resistor lower surface sandwiched between the first electrode lower end edge and the second electrode lower end edge.

In an embodiment of the present disclosure, a thickness of the resistor ranges from 0.3 to 1.0 mm.

In an embodiment of the present disclosure, the resistor is formed of a Ni—Cr alloy or a Cu—Mn alloy.

In an embodiment of the present disclosure, four corners of the resistor second side surfaces are all at a right angle.

In an embodiment of the present disclosure, four corners of the resistor second side surfaces are all curved.

In an embodiment of the present disclosure, the first electrode includes a first internal electrode covering the resistor, a first intermediate electrode covering the internal electrode, and a first external electrode covering the first intermediate electrode, and the internal electrode, the first intermediate electrode, and the first external electrode are all formed of plated layers.

In an embodiment of the present disclosure, the first external electrode is formed of a plated layer containing Sn.

In an embodiment of the present disclosure, the first internal electrode is formed of a Ni plated layer.

In an embodiment of the present disclosure, the first intermediate layer is formed of a Cu plated layer.

In an embodiment of the present disclosure, the first intermediate electrode includes a first intermediate first layer covering the first internal electrode and a first intermediate second layer covering the first intermediate first layer.

In an embodiment of the present disclosure, the first intermediate first layer is formed of a Cu plated layer.

In an embodiment of the present disclosure, the first intermediate second layer is formed of a Ni plated layer.

According to a second embodiment of the present disclosure, there is provided a method for manufacturing a chip resistor, including: preparing a band-shaped resistor formed of a plurality of resistor regions having a lower surface and an upper surface which face mutually opposite sides in a thickness direction, and a pair of side surfaces spaced apart from one another in a width direction; attaching a lower surface protective tape which is continuous in a longitudinal direction of the band-shaped resistor and has a width smaller than that of the band-shaped resistor to the lower surface; attaching an upper surface protective tape which is continuous in the longitudinal direction of the band-shaped resistor to the upper surface; forming a pair of conductive layers which conducts electricity with the band-shaped resistor along the pair of side surfaces; and dividing the band-shaped resistor into individual pieces of every resistor region by cutting the band-shaped resistor in a direction perpendicular to the longitudinal direction of the band-shaped resistor, wherein, in the attaching a lower surface protective tape, both end portions of the lower surface in the width direction are exposed from the lower surface protective tape, and in the forming a pair of conductive layers, the pair of conductive layers are formed on a portion of the band-shaped resistor which is not covered by the lower surface protective tape and the upper surface protective tape.

In an embodiment of the present disclosure, in the attaching a lower surface protective tape, the lower surface protective tape is attached to a center of the lower surface in the width direction.

In an embodiment of the present disclosure, in the attaching an upper surface protective tape, the upper surface protective tape is attached to the entire surface of the upper surface.

In an embodiment of the present disclosure, in the attaching an upper surface protective tape, the upper surface protective tape having a width smaller than that of the band-shaped resistor is attached to the upper surface.

In an embodiment of the present disclosure, a width of the upper surface protective tape used in the attaching an upper surface protective tape is larger than that of the lower surface protective tape used in the attaching a lower surface protective tape.

In an embodiment of the present disclosure, the forming a pair of conductive layers includes forming a pair of internal conductive layers, forming a pair of intermediate conductive layers, and forming a pair of external conductive layers, and the pair of internal conductive layers, the pair of intermediate conductive layers, and the pair of external conductive layers are all formed through plating.

In an embodiment of the present disclosure, the forming a pair of intermediate conductive layers includes forming a pair of intermediate first conductive layers and forming a pair of intermediate second conductive layers.

In an embodiment of the present disclosure, in the forming a pair of internal conductive layers, the pair of internal conductive layers is formed through strike plating.

In an embodiment of the present disclosure, the method further includes detaching each of the lower surface protective tape and the upper surface protective tape from the band-shaped resistor before the dividing the band-shaped resistor into individual pieces of every resistor region.

In an embodiment of the present disclosure, the method further includes detaching the lower surface protective tape from the band-shaped resistor before the dividing the band-shaped resistor into individual pieces of every resistor region.

In an embodiment of the present disclosure, the method further includes adjusting a resistance value of each of the individual pieces after the dividing the band-shaped resistor into individual pieces of every resistor region.

The other features and advantages of the present disclosure will become more apparent from the following description of embodiments, given in conjunction with the accompanying drawings.

DETAILED DESCRIPTION

Embodiments of a chip resistor according to the present disclosure will be now described in detail with reference to the drawings.

First Embodiment

A chip resistor A10 according to a first embodiment of the present disclosure will be described with reference to FIGS. 1 to 5. For the convenience of description, a direction perpendicular to a thickness direction Z of the chip resistor A10 will be referred to as a first direction X (a horizontal direction of the plane view) and a direction perpendicular to any one of the thickness direction Z of the chip resistor A10 and the first direction X will be referred to as a second direction Y (a vertical direction of the plane view).

Figure 1:
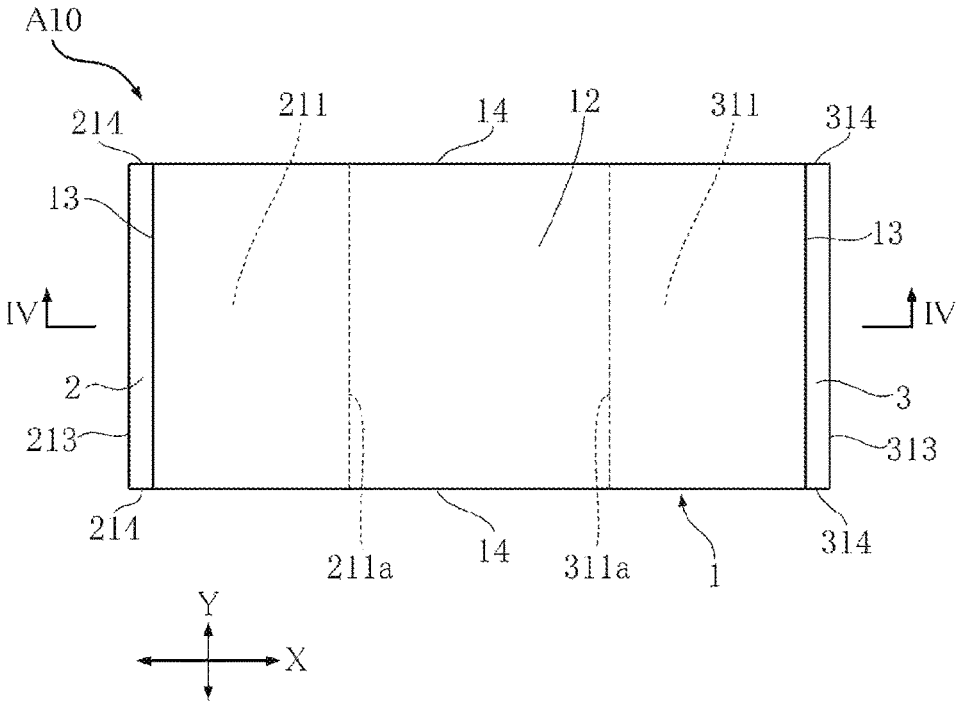
FIG. 1 is a plane view illustrating a chip resistor according to a first embodiment of the present disclosure.
Figure 2:
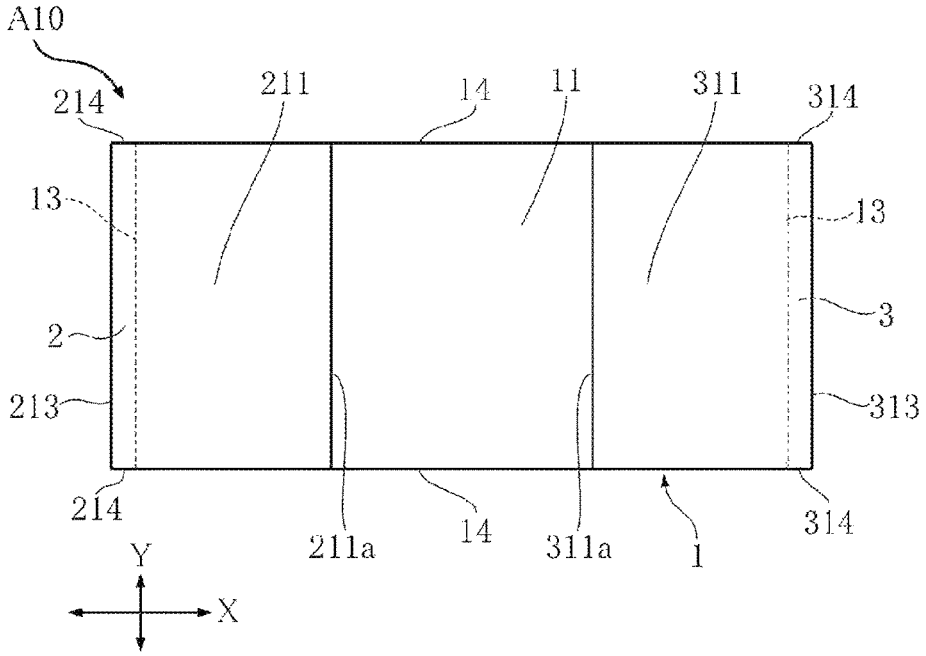
FIG. 2 is a bottom view illustrating the chip resistor of FIG. 1.
Figure 3:
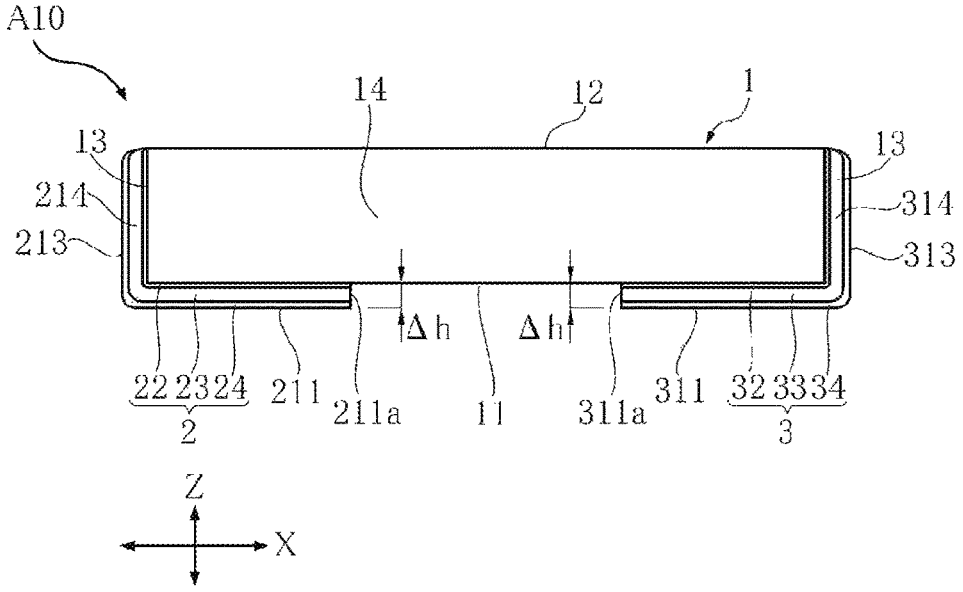
FIG. 3 is a front view illustrating the chip resistor of FIG. 1.
Figure 4:
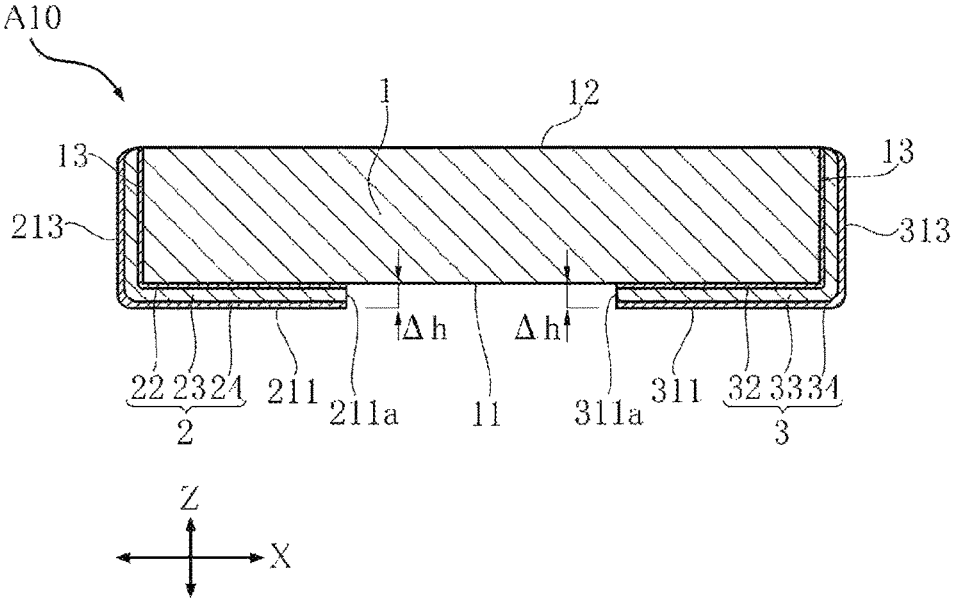
FIG. 4 is a cross-sectional view taken along line Iv-Iv of FIG. 1.
Figure 5:
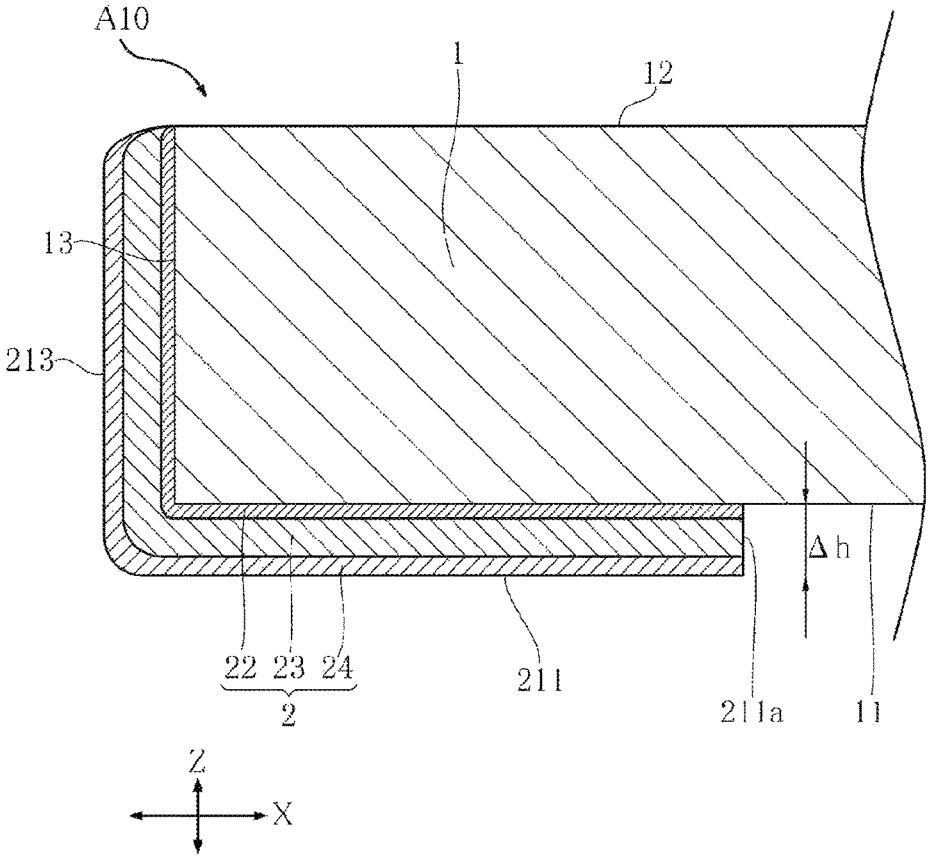
FIG. 5 is a partially enlarged view of a portion of FIG. 4.

FIG. 1 is a plane view illustrating the chip resistor A10. FIG. 2 is a bottom view illustrating the chip resistor 10A. FIG. 3 is a front view illustrating the chip resistor 10A. FIG. 4 is a cross-sectional view taken along line IV-IV of FIG. 1. FIG. 5 is a partially enlarged view of enlarging a portion of FIG. 4.

The chip resistor A10 illustrated in these drawings is a type of chip resistor surface-mounted on a circuit board of various electronic devices. The chip resistor A10 of this embodiment includes a resistor 1, a first electrode 2, and a second electrode 3. In this embodiment, the chip resistor A10 has a rectangular shape when viewed from the plane (when viewed in the thickness direction Z). Further, a dimension of the chip resistor A10 of this embodiment in the first direction X is standardized as 5.0 mm and a dimension of the chip resistor A10 in the second direction Y is standardized as 2.5 mm. As illustrated in FIGS. 3 and 4, cross-sections of the chip resistor A10 taken along the first direction X are uniform in the second direction Y.

The resistor 1 is a device that mainly performs a function of detecting a current. In this embodiment, a thickness of the resistor 1 ranges from 0.3 to 1.0 mm. As illustrated in FIGS. 1 and 2, the resistor 1 has a rectangular shape in which the first direction X is a longer side. The resistor 1 is formed of, for example, a Ni—Cr alloy or a Cu—Mn alloy, but is not limited thereto as long as the resistor 1 is a metal plate resistor. The resistor 1 has a resistor lower surface 11, a resistor upper surface 12, a pair of resistor first side surfaces 13 and a pair of resistor second side surfaces 14.

As illustrated in FIG. 3, the resistor lower surface 11 is a surface that faces downwards. Further, the resistor upper surface 12 is a surface that faces upwards. The resistor lower surface 11 and the resistor upper surface 12 face mutually opposite sides in the thickness direction Z of the chip resistor A10. All of the resistor lower surface 11 and the resistor upper surface 12 are flat. In this embodiment, as illustrated in FIGS. 2 and 3, a portion of the resistor lower surface 11 is covered by a first electrode 2 and a second electrode 3. Further, in this embodiment, the resistor upper surface 12 is entirely exposed, as illustrated in FIGS. 1 and 3.

As illustrated in FIGS. 1 and 2, the pair of resistor first side surfaces 13 are spaced apart from each other in the first direction X. The first electrode 2 is formed along one resistor first side surface 13. Further, the second electrode 3 is formed along the other resistor first side surface 13. In this embodiment, the pair of resistor first side surfaces 13 is both covered by the first electrode 2 and the second electrode 3.

As illustrated in FIGS. 1 and 2, the pair of resistor second side surfaces 14 is spaced apart from each other in the second direction Y. In this embodiment, the pair of resistor second side surfaces 14 is both exposed. Further, in this embodiment, the corners of the resistor second side surfaces 14 are all at right angle.

The first electrode 2 and the second electrode 3 are electrodes for securing electrical connection between the chip resistor A10 and a circuit board of various electronic devices through a solder layer. As illustrated in FIGS. 1 and 2, the second electrode 3 in the first direction X is spaced apart from the first electrode 2.

The first electrode 2 is one electrode of the chip resistor A10 formed along one resistor first side surface 13. As illustrated in FIGS. 3 and 4, the first electrode 2 is electrically connected with the resistor 1 by covering a portion of the resistor lower surface 11 and one resistor first side surface 13. The first electrode 2 has a first electrode lower surface 211, a first electrode lower end edge 211*a*, a first electrode first side surface 213, and a pair of first electrode second side surfaces 214.

As illustrated in FIGS. 2 and 3, the first electrode lower surface 211 faces downwards like the resistor lower surface 11. In the first direction X, an outer edge of the first electrode lower surface 211 is connected to the first electrode first side surface 213, and an inner edge of the first electrode lower surface 211 is connected to the first electrode lower end edge 211*a*. In the second direction Y, both ends of the first electrode lower surface 211 are connected to the pair of first electrode second side surfaces 214. The first electrode lower surface 211 is flat.

As illustrated in FIGS. 2 and 3, the first electrode lower end edge 211*a* is a surface extending from an inner edge of the first electrode lower surface 211 toward the resistor lower surface 11 in the thickness direction Z of the chip resistor A10. The first electrode lower end edge 211*a* is in contact with the resistor lower surface 11.

As illustrated in FIG. 3, the first electrode first side surface 213 is a surface standing from an outer edge of the first electrode lower surface 211 upwards and connected to the resistor upper surface 12. The first electrode first side surface 213 faces toward the first direction X.

As illustrated in FIGS. 2 and 3, the pair of first electrode second side surfaces 214 is a pair of surfaces standing from both ends of the first electrode lower surface 211 and connected to both ends of the first electrode first side surface 213 in the second direction Y. The pair of first electrode second side surfaces 214 both face mutually opposite sides in the second direction Y. In this embodiment, as illustrated in FIG. 3, the first electrode second side surface 214 has an L shape. Further, in this embodiment, as illustrated in FIGS. 1 and 2, the first electrode second side surface 214 is a surface flush with the resistor second side surface 14.

As illustrated in FIGS. 3, 4, and 5, the first electrode 2 includes a first internal electrode 22 covering the resistor 1, a first intermediate electrode 23 covering the first internal electrode 22, and a first external electrode 24 covering the first intermediate electrode 23. The first internal electrode 22, the first intermediate electrode 23, and the first external electrode 24 are all formed of plated layers.

The first internal electrode 22 covers a portion of the resistor lower surface 11 and one resistor first side surface 13. The first internal electrode 22 is formed of a Ni plated layer. The first intermediate electrode 23 described later is formed of a Cu plated layer, and when the Cu plated layer is formed directly on the resistor 1, there is a concern that the Cu plated layer may peel. Thus, in this embodiment, in order to prevent peeling of the Cu plated layer, the Ni plated layer is formed as the first internal electrode 22 on the resistor 1.

The first intermediate electrode 23 covers the first internal electrode 22 that forms a portion other than the first electrode lower end edge 211*a* and the pair of first electrode second side surfaces 214 in the first electrode 2. The first intermediate electrode 23 is formed of a Cu plated layer. The first intermediate electrode 23 forms a major part of the first electrode 2.

The first external electrode 24 covers the first intermediate electrode 23 that forms a portion other than the first electrode lower end edge 211*a* and the pair of first electrode second side surfaces 214 in the first electrode 2. The first external electrode 24 is formed of a plated layer containing Sn such as, for example, solder plating. When the chip resistor A10 is surface-mounted on a circuit board of various electronic devices through solder bonding, the first external electrode 24 serves to facilitate attachment of solder to the first electrode 2 and also prevent erosion of the first intermediate electrode 23 resulting from the solder bonding.

As illustrated in FIG. 3, only the first external electrode 24 is exposed at both the first electrode lower surface 211 and the first electrode first side surface 213 in the first electrode 2. Each of the first internal electrode 22, the first intermediate electrode 23, and the first external electrode 24 is exposed at the first electrode lower end edge 211*a* and the pair of first electrode second side surfaces 214.

The second electrode 3 is the other electrode of the chip resistor A10 formed along the other resistor first side surface 13. As illustrated in FIGS. 3 and 4, the second electrode 3 is electrically connected with the resistor 1 by covering a portion of the resistor lower surface 11 and the other resistor first side surface 13. The second electrode 3 has a second electrode lower surface 311, a second electrode lower end edge 311*a*, a second electrode first side surface 313, and a pair of second electrode second side surfaces 314. In this embodiment, a configuration of the second electrode 3 is the same as that of the first electrode 2.

As illustrated in FIGS. 2 and 3, the second electrode lower surface 311 faces downwards like the resistor lower surface 11. In the first direction X, an outer edge of the second electrode lower surface 311 is connected to the second electrode first side surface 313, and an inner edge of the second electrode lower surface 311 is connected to the second electrode lower end edge 311*a*. In the second direction Y, both ends of the second electrode lower surface 311 is connected to the pair of second electrode second side surfaces 314. The second electrode lower surface 311 is flat.

As illustrated in FIGS. 2 and 3, the second electrode lower end edge 311*a* is a surface extending from an inner edge of the second electrode lower surface 311 toward the resistor lower surface 11 in the thickness direction Z of the chip resistor A10. The second electrode lower end edge 311*a* is in contact with the resistor lower surface 11.

As illustrated in FIG. 3, the second electrode first side surface 313 is a surface standing from an outer edge of the second electrode lower surface 311 upwards and connected to the resistor upper surface 12. The second electrode first side surface 313 faces toward the first direction X.

As illustrated in FIGS. 2 and 3, the pair of second electrode second side surfaces 314 is a pair of surfaces standing from both ends of the second electrode lower surface 311 and also connected to both ends of the second electrode first side surface 313 in the second direction Y. The pair of second electrode second side surfaces 314 both face mutually opposite sides in the second direction Y. In this embodiment, as illustrated in FIG. 3, the second electrode second side surface 314 has an L shape. Further, in this embodiment, as illustrated in FIGS. 1 and 2, the second electrode second side surface 314 is a surface flush with the resistor second side surface 14. Thus, in this embodiment, the resistor second side surface 14, and the first electrode second side surface 214 and the second electrode second side surface 314 in the second direction Y are all flush with each other. However, this embodiment is not limited thereto, and for example, the first electrode second side surface 214 and the second electrode second side surface 314 may cover a portion of the resistor second side surface 14.

As illustrated in FIGS. 3 and 4, the second electrode 3 includes a second internal electrode 32 covering the resistor 1, a second intermediate electrode 33 covering the second internal electrode 32, and a second external electrode 34 covering the second intermediate electrode 33. The second internal electrode 32, the second intermediate electrode 33, and the second external electrode 34 are all formed of plated layers.

The second internal electrode 32 covers a portion of the resistor lower surface 11 and the other resistor first side surface 13. The second internal electrode 32 is formed of a Ni plated layer. A shape and a material of the second internal electrode 32 are the same as those of the first internal electrode 22.

The second intermediate electrode 33 covers the second internal electrode 32 that forms a portion other than the second electrode lower end edge 311*a* and the pair of second electrode second side surfaces 314 in the second electrode 3. The second intermediate electrode 33 is formed of a Cu plated layer. A shape and a material of the second intermediate electrode 33 are the same as those of the first intermediate electrode 23.

The second external electrode 34 covers the second intermediate electrode 33 that forms a portion other than the second electrode lower end edge 311*a* and the pair of second electrode second side surfaces 314 in the second electrode 3. The second external electrode 34 is formed of plated layer containing Sn such as, for example, solder plating. A shape and a material of the second external electrode 34 are the same as those of the first external electrode 24.

As illustrated in FIG. 3, only the second external electrode 34 is exposed at both the second electrode lower surface 311 and the second electrode first side surface 313 in the second electrode 3. Each of the second internal electrode 32, the second intermediate electrode 33, and the second external electrode 34 is exposed at the second electrode lower end edge 311*a* and the pair of second electrode second side surfaces 314.

As illustrated in FIG. 2, both the first electrode lower end edge 211*a* and the second electrode lower end edge 311*a* are continuously formed on the resistor lower surface 11 from one resistor second side surface 14 to the other resistor second side surface 14. Also, as illustrated in FIGS. 3 and 4, step Δh is formed on the resistor lower surface 11 by the first electrode lower end edge 211*a* and the second electrode lower end edge 311*a*, respectively. A height of the step Δh is equivalent to a thickness of the plated layer that forms the first electrode 2 and the second electrode 3.

As illustrated in FIGS. 2 and 3, a portion of the resistor lower surface 11, which is sandwiched between the first electrode lower end edge 211*a* and the second electrode lower end edge 311*a*, is exposed. In this embodiment, both the first electrode lower end edge 211*a* and the second electrode lower end edge 311*a* are parallel to the second direction Y.

Next, a method for manufacturing the chip resistor A10 will be described with reference to FIGS. 6 to 14. Among FIGS. 6 to 14, the drawings other than FIGS. 9 and 11 are perspective views illustrating a process according to a manufacturing method of the chip resistor A10. FIG. 9 is a front view illustrating a process according to a manufacturing method of the chip resistor A10. FIG. 11 is a partially enlarged cross-sectional view of a portion of a cross-section taken along line XI-XI of FIG. 10.

Figure 6:
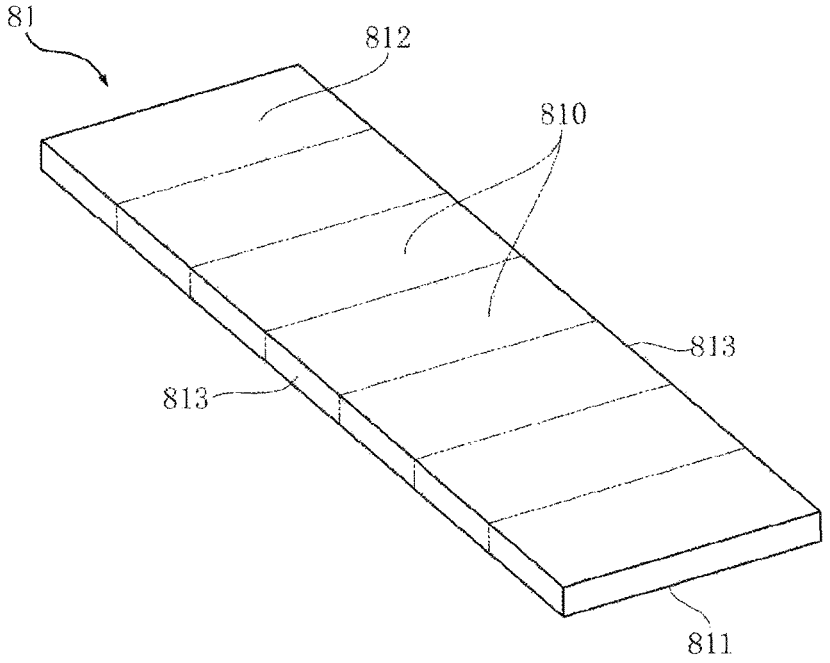
FIG. 6 is a perspective view illustrating a process of a method for manufacturing the chip resistor of FIG. 1.

First, as illustrated in FIG. 6, a band-shaped resistor 81 formed of, for example, a Ni—Cr alloy or a Cu—Mn alloy is prepared. Also, a material of the band-shaped resistor 81 is not limited thereto as long as it is a metal plate resistor. The band-shaped resistor 81 includes a plurality of resistor regions 810. The resistor regions 810 are rectangular regions, divided by the two-dot chain lines illustrated in FIG. 6, when viewed from a plan view. The rectangular regions are regions to become the resistor 1 of the chip resistor A10. In this embodiment, the band-shaped resistor 81 is a continuum in which longer sides of the plurality of resistor regions 810 are coupled to each other. The band-shaped resistor 81 has a lower surface 811, an upper surface 812, and a pair of side surfaces 813. The lower surface 811 is a surface facing downwards. Further, the upper surface 812 is a surface facing upwards. The lower surface 811 and the upper surface 812 face mutually opposite sides in the thickness direction of the band-shaped resistor 81. The lower surface 811 and the upper surface 812 are all flat. The pair of side surfaces 813 are surfaces spaced apart from each other in a width direction of the band-shaped resistor 81. The pair of side surfaces 813 intersects with the lower surface 811 and the upper surface 812, respectively.

Figure 7:
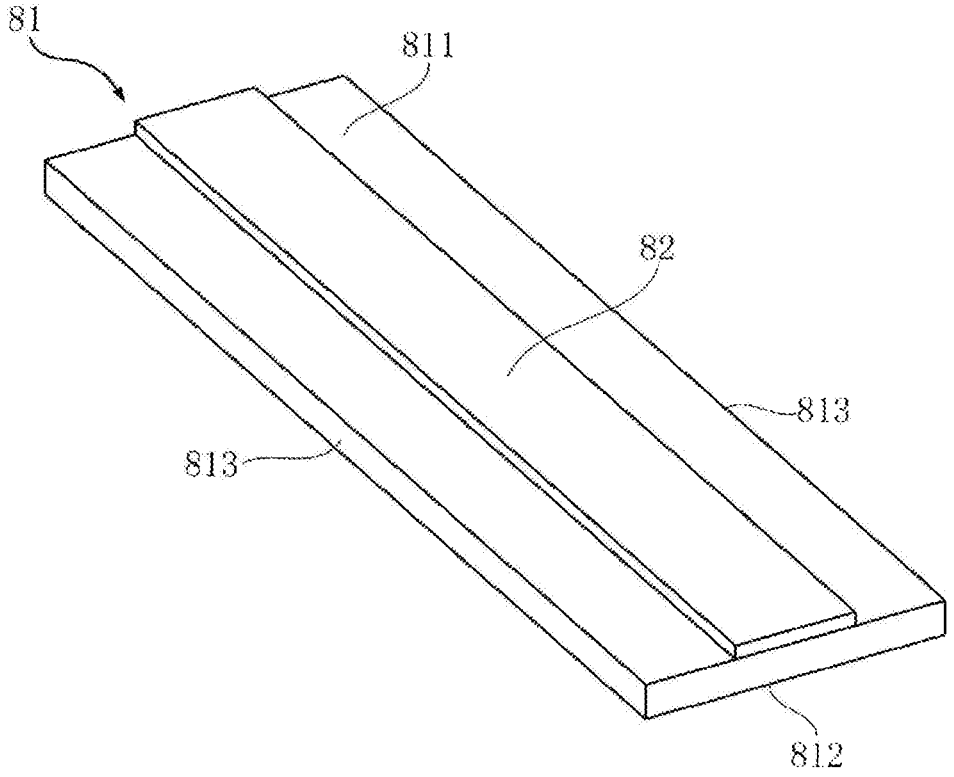
FIG. 7 is a perspective view illustrating a process of a method for manufacturing the chip resistor of FIG. 1.

Subsequently, as illustrated in FIG. 7, a lower surface protective tape 82, which extends in a longitudinal direction of the band-shaped resistor 81 and also has a width smaller than that of the band-shaped resistor 81, is attached to the lower surface 811. The lower surface protective tape 82 is a masking tape for plating. The lower surface protective tape 82 is formed of, for example, polyester as a base material, and has an adhesive layer formed on one surface thereof. Further, the lower surface protective tape 82 has chemical resistance. At this time, both end portions of the lower surface 811 in the width direction are exposed from the lower surface protective tape 82. In this embodiment, the lower surface protective tape 82 is attached to the center of the lower surface 811 in the width direction.

Figure 8:
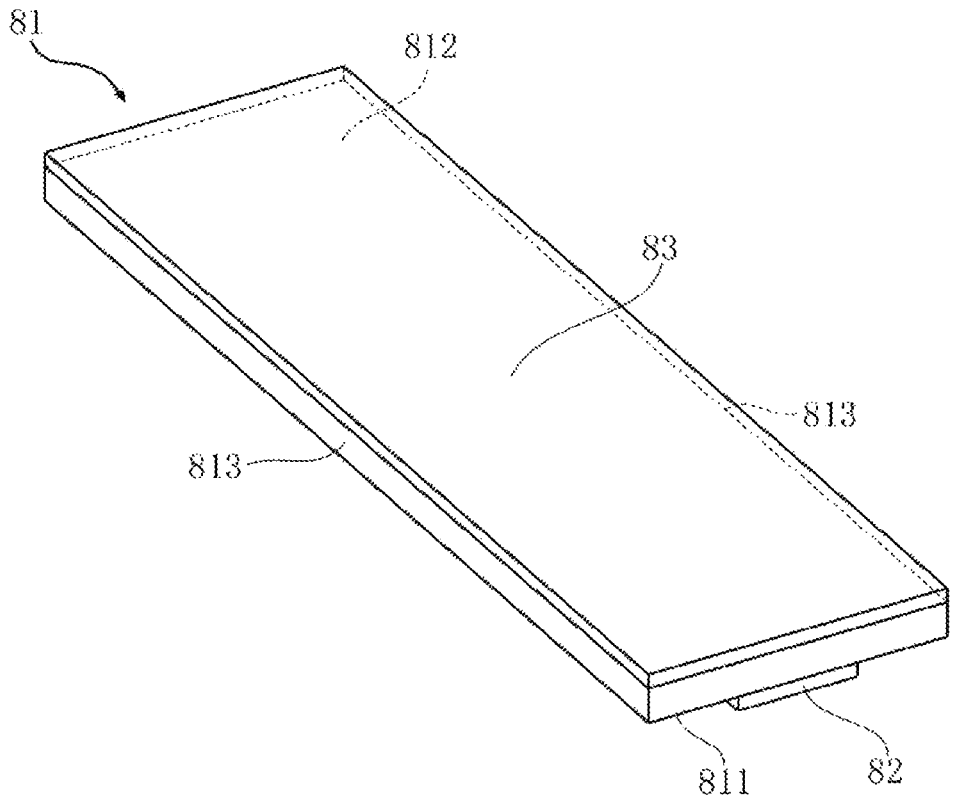
FIG. 8 is a perspective view illustrating a process of a method for manufacturing the chip resistor of FIG. 1.
Figure 9:
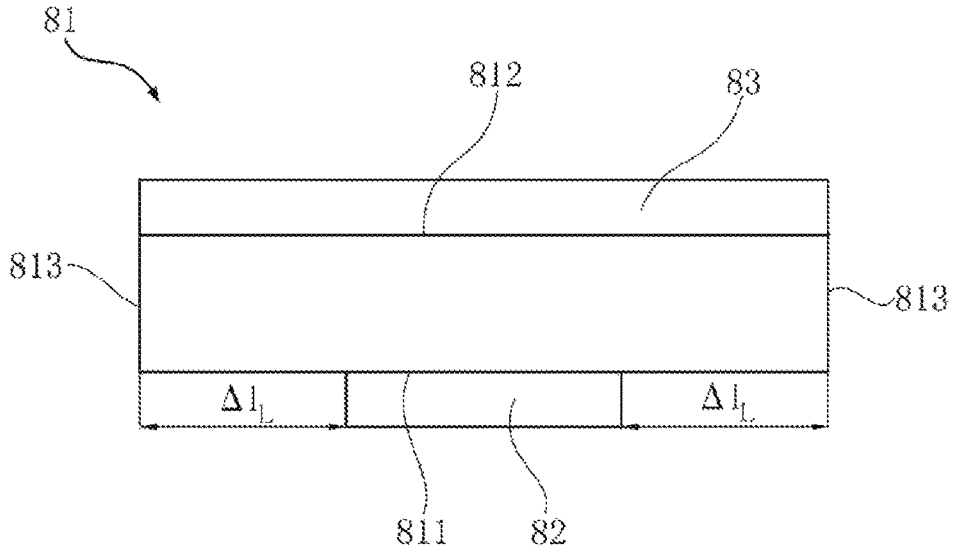
FIG. 9 is a front view illustrating a process of a method for manufacturing the chip resistor of FIG. 1.

Thereafter, as illustrated in FIG. 8, an upper surface protective tape 83, which extends in a longitudinal direction of the band-shaped resistor 81, is attached to the upper surface 812. The upper surface protective tape 83 is the same tape as the lower surface protective tape 82. In this embodiment, the upper surface protective tape 83 is attached to the entire surface of the upper surface 812.

A state where the lower surface protective tape 82 and the upper surface protective tape 83 are each attached to the band-shaped resistor 81 is illustrated in FIG. 9. The widths $\Delta l_L$ of both end portions of the lower surface 811 exposed from the lower surface protective tape 82 in the width direction are equal to each other. Further, a step is formed due to the lower surface protective tape 82 in the lower surface 811. Also, the process of attaching the lower surface protective tape 82 and the process of attaching the upper surface protective tape 83 may also be performed in a reverse order.

Figure 10:
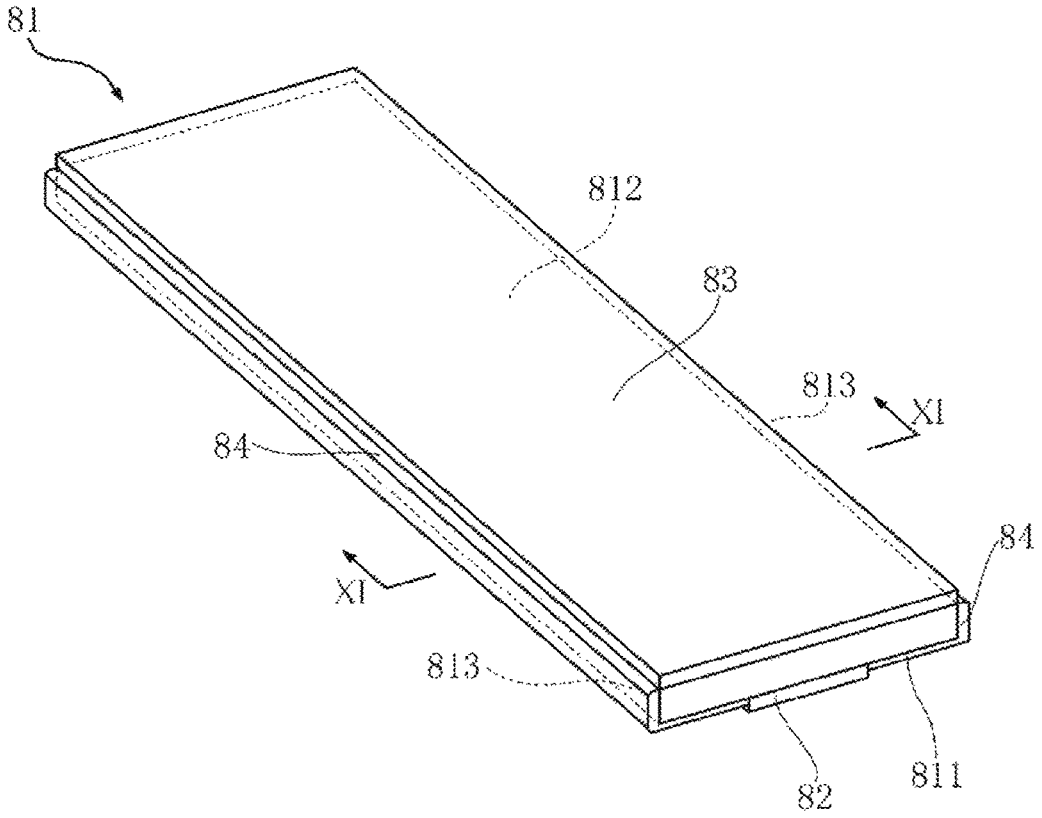
FIG. 10 is a perspective view illustrating a process of a method for manufacturing the chip resistor of FIG. 1.
Figure 11:
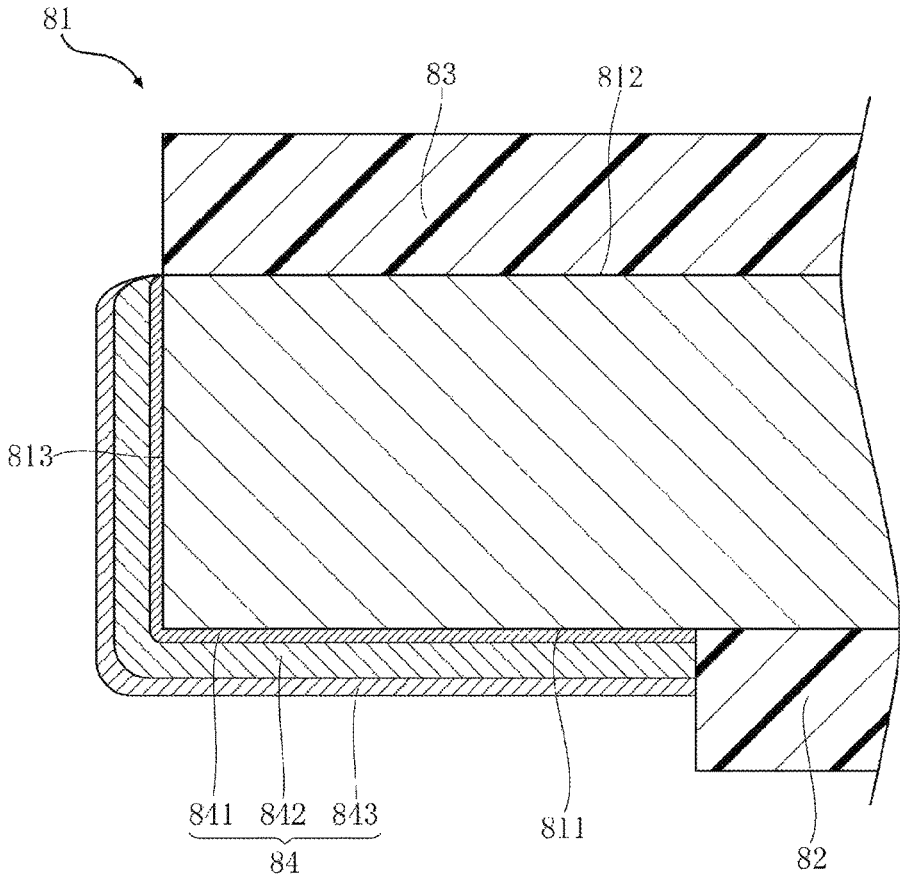
FIG. 11 is a partially enlarged cross-sectional view of a portion of a cross-section taken along line XI-XI of FIG. 10.

Subsequently, as illustrated in FIG. 10, a pair of conductive layers 84 which conducts electricity with the band-shaped resistor 81 is formed along the pair of side surfaces 813. The pair of conductive layers 84 corresponds to the first electrode 2 and the second electrode 3 of the chip resistor A10. The pair of conductive layers 84 is formed on a portion of the band-shaped resistor 81 which is not covered by the lower surface protective tape 82 and the upper surface protective tape 83, that is, on the pair of side surfaces 813 and on both end portions of the lower surface 811 in the width direction, exposed from the lower surface protective tape 82.

As illustrated in FIG. 11, in this embodiment, the process of forming the pair of conductive layers 84 includes a process of forming a pair of internal conductive layers 841, a process of forming a pair of intermediate conductive layers 842, and a process of forming a pair of external conductive layers 843. The pair of internal conductive layers 841 corresponds to the first internal electrode 22 and the second internal electrode 32, respectively, the pair of intermediate conductive layers 842 corresponds to the first intermediate electrode 23 and the second intermediate electrode 33, respectively, and the pair of external conductive layers 843 corresponds to the first external electrode 24 and the second external electrode 34, respectively. The pair of internal conductive layers 841, the pair of intermediate conductive layers 842, and the pair of external conductive layers 843 are all formed through plating. The pair of internal conductive layers 841 is formed through Ni plating. The pair of intermediate conductive layers 842 is formed through Cu plating. The pair of external conductive layers 843 is formed through plating containing Sn such as solder plating. Among them, the pair of internal conductive layers 841 may be formed through strike plating having a relatively small thickness. In this case, the pair of internal conductive layers 841 is formed through Ni strike plating. Further, in this embodiment, a thickness of the conductive layer 84 is smaller than that of the lower surface protective tape 82.

Figure 12:
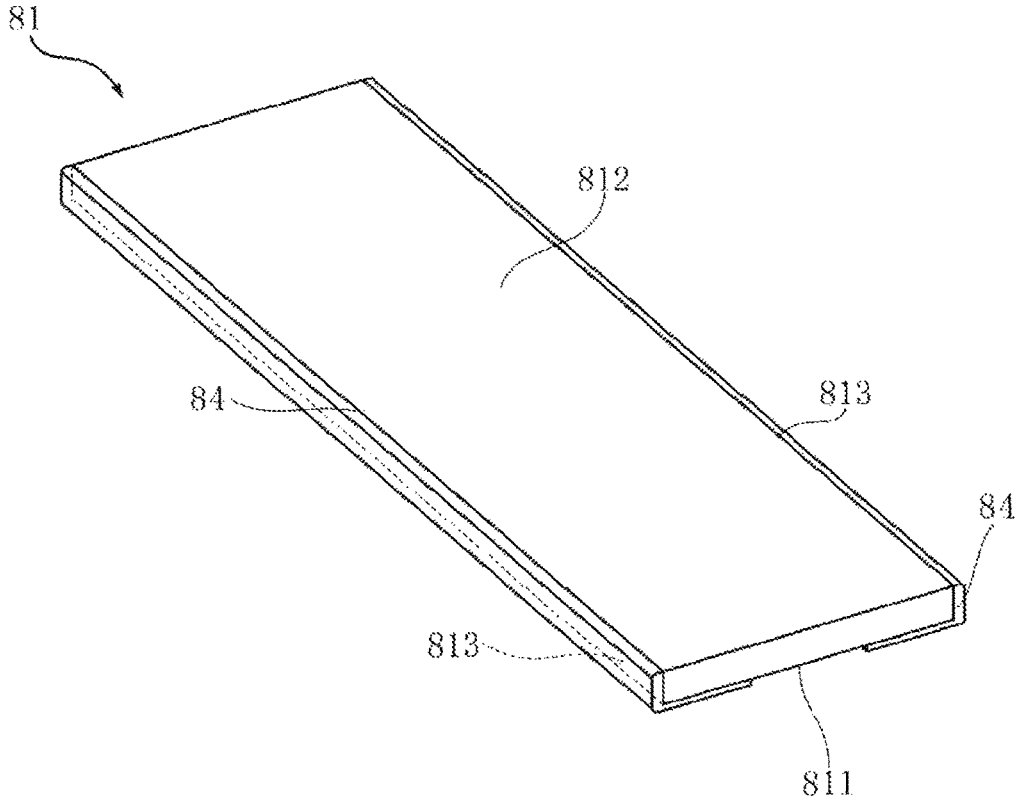
FIG. 12 is a perspective view illustrating a process of a method for manufacturing the chip resistor of FIG. 1.
Figure 13:
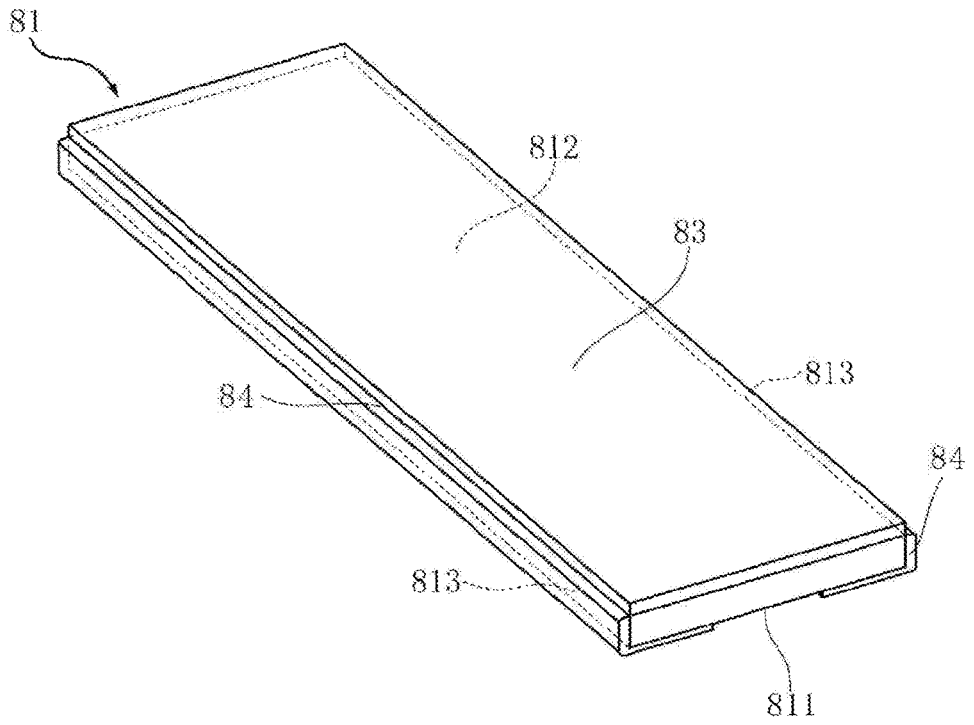
FIG. 13 is a perspective view illustrating a process of a method for manufacturing the chip resistor of FIG. 1.

Subsequently, as illustrated in FIG. 12, each of the lower surface protective tape 82 and the upper surface protective tape 83 is detached from the band-shaped resistor 81. At this time, as illustrated in FIG. 13, the lower surface protective tape 82 may be detached from the band-shaped resistor 81, while the upper surface protective tape 83 may remain attached to the band-shaped resistor 81, rather than being detached therefrom.

Figure 14:
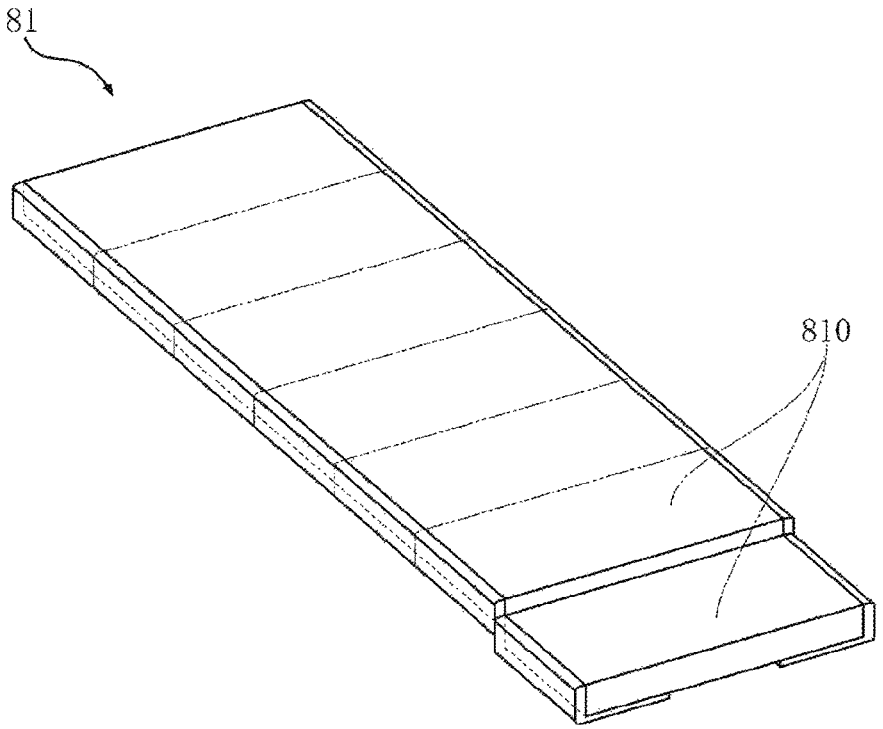
FIG. 14 is a perspective view illustrating a process of a method for manufacturing the chip resistor of FIG. 1.

Subsequently, as illustrated in FIG. 14, the band-shaped resistor 81 is cut in a direction perpendicular to the longitudinal direction of the band-shaped resistor 81 to divide the band-shaped resistor 81 into individual pieces 85 of the resistor regions 810. Specifically, the band-shaped resistor 81 is cut along the two-dot chain lines illustrated in FIG. 14, for example, by a cutting device (not shown). Among exposed surfaces of the resistor region 810 of the individual piece 85, a surface which faces upwards may be the resistor upper surface 12 of the chip resistor A10 and a surface which faces the side may be the resistor second side surface 14 of the chip resistor A10.

Subsequently, a resistance value of each of the individual pieces 85 is adjusted. The resistance value may be adjusted by bringing a probe for measuring a resistance value (not shown) into contact with the pair of conductive layers 84 (the first electrode 2 and the second electrode 3) formed on each of the individual pieces 85 and polishing an exposed surface (the resistor second side surface 14) of the resistor region 810 of each of the individual pieces 85 that does not reach a target resistance value through a grinder or the like. The chip resistor A10 is manufactured through the above processes.

Next, the operational effects of the chip resistor A10 will be described.

According to this embodiment, in the chip resistor A10, the first electrode 2 and the second electrode 3 are electrically connected with the resistor 1 by covering a portion of the resistor lower surface 11 and the resistor first side surface 13, respectively. Further, the chip resistor A10 has the first electrode lower end edge 211*a* and the second electrode lower end edge 311*a*, which are in contact with the resistor lower surface 11, and both the first electrode lower end edge 211*a* and the second electrode lower end edge 311*a* are continuously formed on the resistor lower surface 11 to extend from one resistor second side surface 14 to the other resistor second side surface 14. Further, steps Δh are formed by the first electrode lower end edge 211*a* and the second electrode lower end edge 311*a* on the resistor lower surface 11, respectively. With this configuration, the first electrode 2 and the second electrode 3 formed of plated layers, which are formed with plated layers, can be directly formed to be spaced apart from each other on the resistor 1 formed of a metal plate, respectively. Thus, it is possible to reduce the size of the chip resistor A10 using the metal plate resistor.

The first electrode 2 and the second electrode 3 have the first electrode first side surface 213 and the second electrode first side surface 313, respectively. The first external electrode 24 and the second external electrode 34 are only exposed from the first electrode first side surface 213 and the second electrode first side surface 313. The first external electrode 24 and the second external electrode 34 are formed of plated layers containing Sn such as solder plating. With this configuration, when the chip resistor A10 is surface-mounted on a circuit board of various electronic devices through soldering, it is possible to form a solder fillet on each of the first electrode first side surface 213 and the second electrode first side surface 313.

FIGS. 15 to 26 illustrate other embodiments of the present disclosure. Further, in these drawings, the components which are the same as or similar to those of the chip resistor A10 described above will be denoted by the same reference numerals and overlapping descriptions will be omitted.

First Modification of First Embodiment

Figure 15:
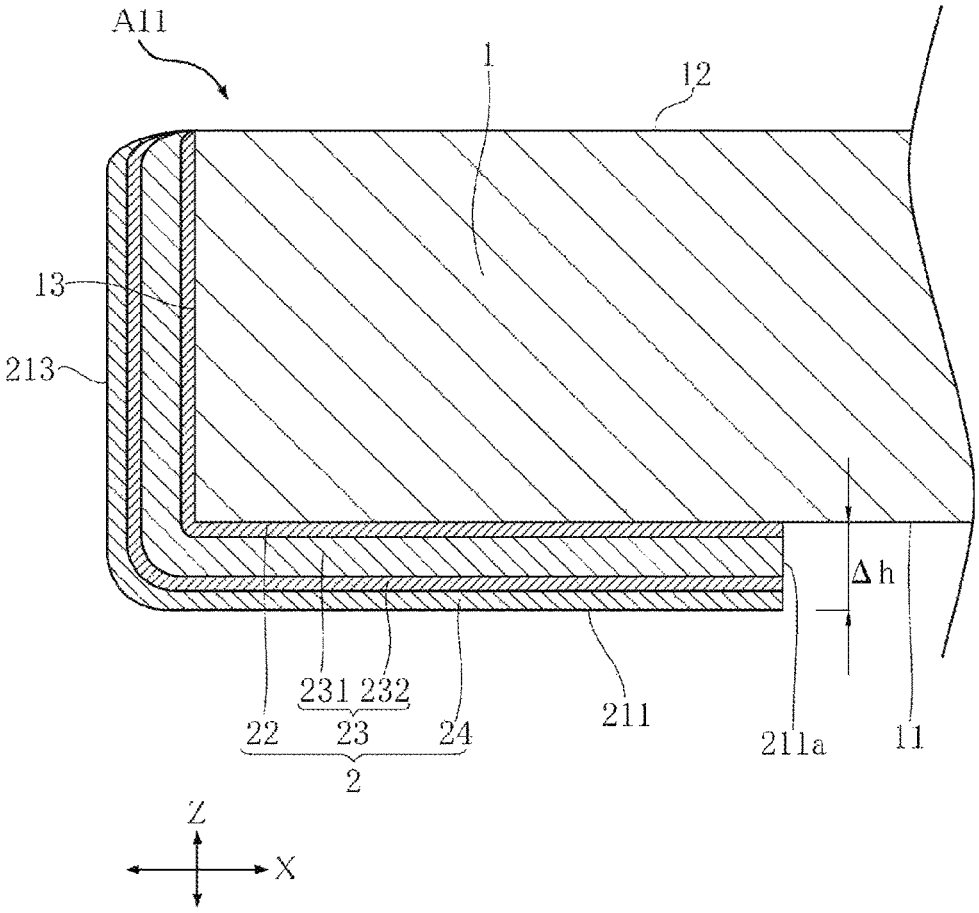
FIG. 15 is a partially enlarged cross-sectional view of a chip resistor according to a first modification of the first embodiment of the present disclosure (the same part as the part illustrated in FIG. 5).
Figure 16:
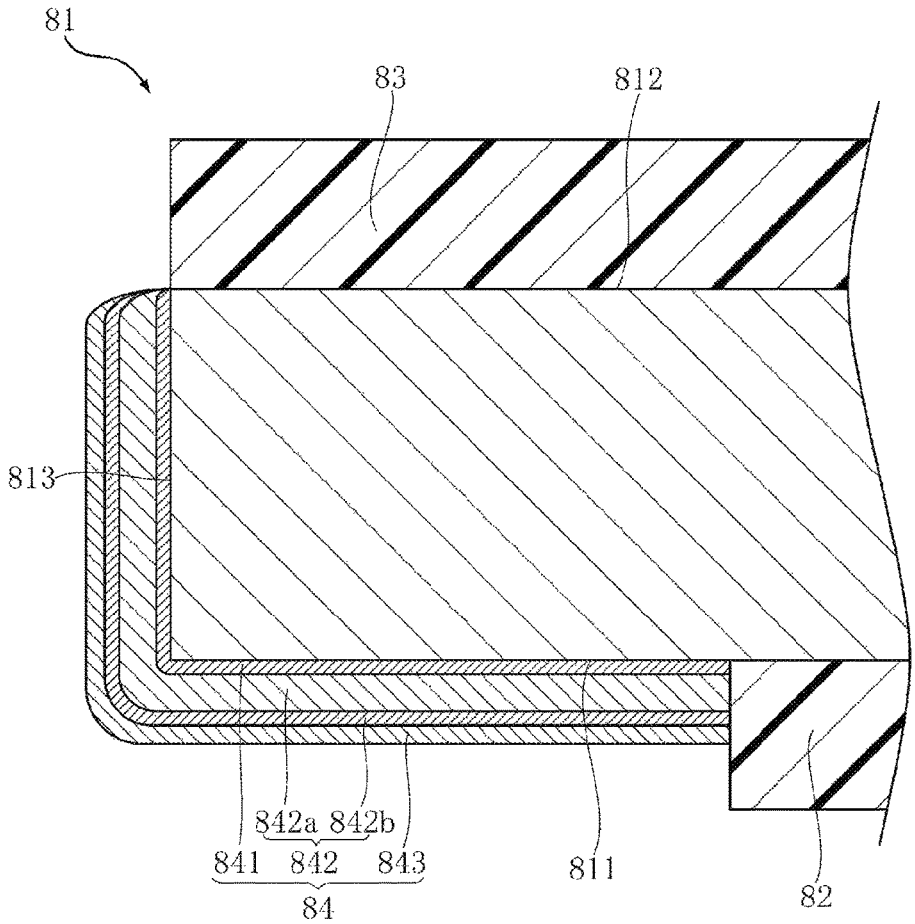
FIG. 16 is a partially enlarged cross-sectional view illustrating a process of a method for manufacturing the chip resistor of FIG. 15 (the same part as the part illustrated in FIG. 11).

A chip resistor A11 according to a first modification of the first embodiment of the present disclosure will be described with reference to FIGS. 15 and 16. FIG. 15 is a partially enlarged cross-sectional view of the chip resistor A11 representing the same part as the part illustrated in FIG. 5. FIG. 16 is a partially enlarged cross-sectional view illustrating a process of a method for manufacturing the chip resistor A11 representing the same part as the part illustrated in FIG. 11.

A configuration of the first electrode 2 and the second electrode 3 of the chip resistor A11 of this modification is different from that of the chip resistor A10 described above. In this modification, the first intermediate electrode 23 of the first electrode 2 includes a first intermediate first layer 231 and a first intermediate second layer 232. As illustrated in FIG. 15, the first electrode 2 includes a first internal electrode 22 covering the resistor 1, the first intermediate first layer 231 covering the first internal electrode 22, the first intermediate second layer 232 covering the first intermediate first layer 231, and a first external electrode 24 covering the first intermediate second layer 232. The first internal electrode 22, the first intermediate first layer 231, the first intermediate second layer 232, and the first external electrode 24 are all formed of plated layers. The first internal electrode 22 is formed of a Ni plated layer. The first intermediate first layer 231 is formed of a Cu plated layer. The first intermediate second layer 232 is formed of a Ni plated layer. The first external electrode 24 is formed of a plated layer containing Sn such as, for example, solder plating.

In this modification, the second intermediate electrode 33 of the second electrode 3 includes a second intermediate first layer 331 and a second intermediate second layer 332. Also, in this modification, like the chip resistor A10, a configuration of the second electrode 3 is the same as that of the first electrode 2. That is, a shape and a material of the first internal electrode 22 and the second internal electrode 32, a shape and a material of the first intermediate first layer 231 and the second intermediate first layer 331, a shape and a material of the first intermediate second layer 232 and the second intermediate second layer 332, and a shape and a material of the first external electrode 24 and the second external electrode 34 are the same. Thus, a description of each of the second internal electrode 32, the second intermediate first layer 331, the second intermediate second layer 332, and the second external electrode 34 that form the second electrode 3 is the same as that of the first electrode 2, and thus, it will be omitted.

Subsequently, a process of forming another pair of conductive layers 84 different from the chip resistor A10 in manufacturing the chip resistor A11 will be described. As illustrated in FIG. 16, in this modification, a process of forming a pair of intermediate conductive layers 842 in the process of forming the pair of conductive layers 84 includes a process of forming a pair of intermediate first conductive layers 842*a*, and a process of forming a pair of intermediate second conductive layers 842*b*. The pair of intermediate first conductive layers 842*a* corresponds to the first intermediate first layer 231 and the second intermediate first layer 331 respectively, and the pair of intermediate second conductive layers 842*b* correspond to the first intermediate second layer 232 and the second intermediate second layer 332 respectively. The pair of intermediate first conductive layers 842*a* and the pair of intermediate second conductive layers 842*b* are all formed through plating. The pair of intermediate first conductive layers 842*a* is formed through Cu plating. The pair of intermediate second conductive layers 842*b* is formed through Ni plating. Also, in this modification, like the chip resistor A10, the pair of internal conductive layers 841 may be formed through Ni strike plating. Further, in this modification, a thickness of the conductive layer 84 is smaller than that of the lower surface protective tape 82.

Also, in this modification, since each of the first electrode 2 and the second electrode 3 formed of plated layers can be formed directly on the resistor 1 formed of a metal plate, it is possible to reduce the size of the chip resistor A11 using the metal plate resistor. Further, by dividing the first intermediate electrode 23 into the first intermediate first layer 231 and the first intermediate second layer 232 and the second intermediate electrode 33 into the second intermediate first layer 331 and the second intermediate second layer 332, it is possible to form a Ni plated layer between a Cu plated layer and a plated layer containing Sn such as solder plating. Through the formation of the Ni plated layer, the Cu plated layer is further protected from heat and impact, and thus the quality of the chip resistor A11 is enhanced.

Second Modification of First Embodiment

Figure 17:
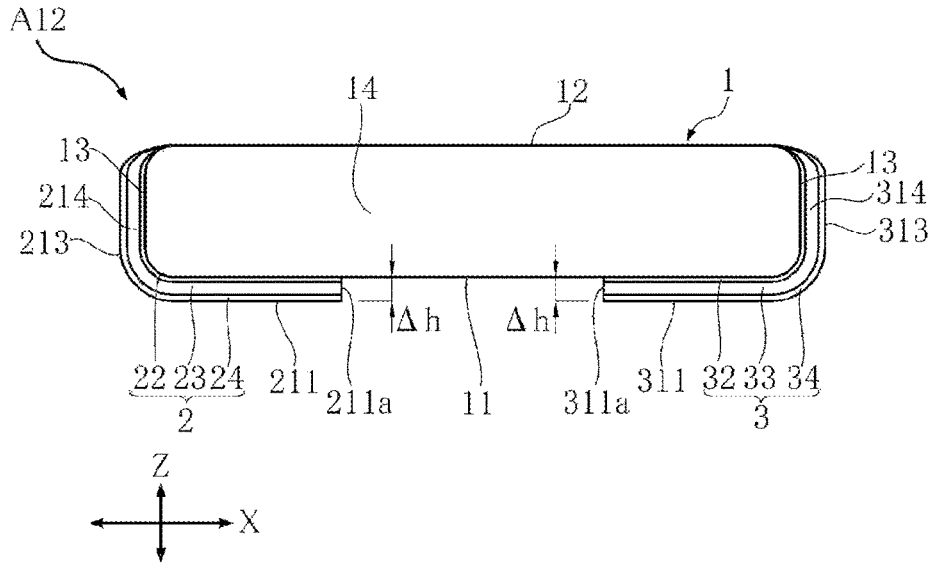
FIG. 17 is a front view illustrating a chip resistor according to a second modification of the first embodiment of the present disclosure.

A chip resistor A12 according to a second modification of the first embodiment of the present disclosure will be described with reference to FIG. 17. FIG. 17 is a front view illustrating the chip resistor A12.

A shape of the resistor 1 of the chip resistor A12 of this modification is different from that of the chip resistor A10. As illustrated in FIG. 17, in this modification, the corners of the resistor second side surface 14 are all curved.

Also, in this modification, since each of the first electrode 2 and the second electrode 3 formed of plated layers can be formed directly on the resistor 1 formed of a metal plate, it is possible to reduce the size of the chip resistor A12 using the metal plate resistor.

Second Embodiment

Figure 18:
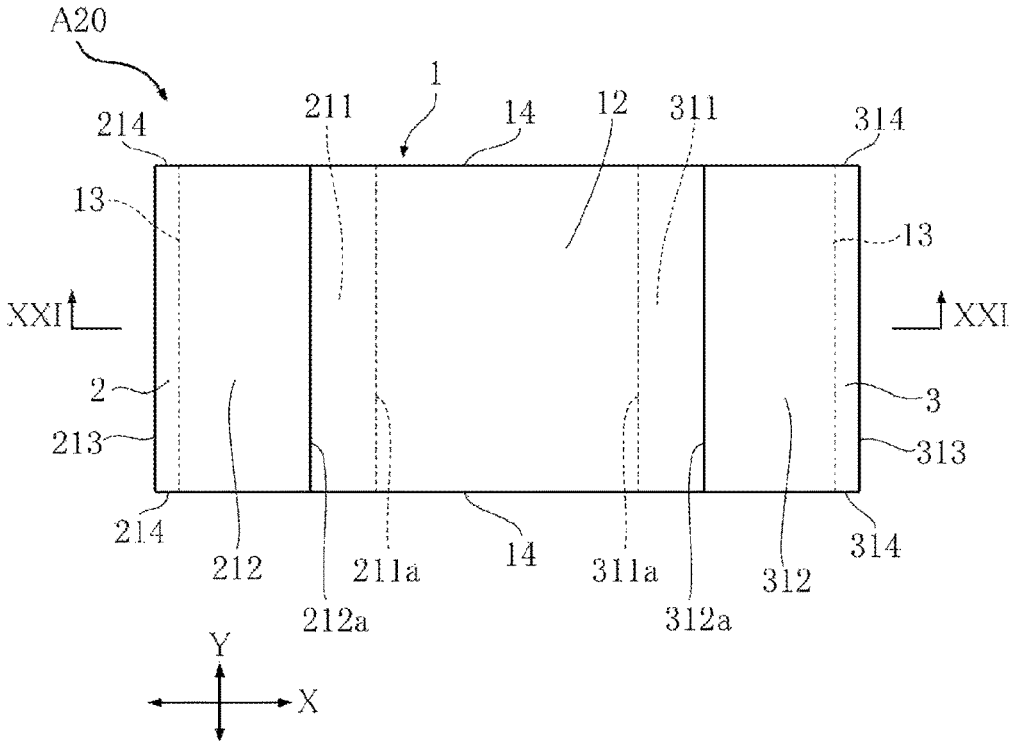
FIG. 18 is a plan view illustrating a chip resistor according to a second embodiment of the present disclosure.
Figure 19:
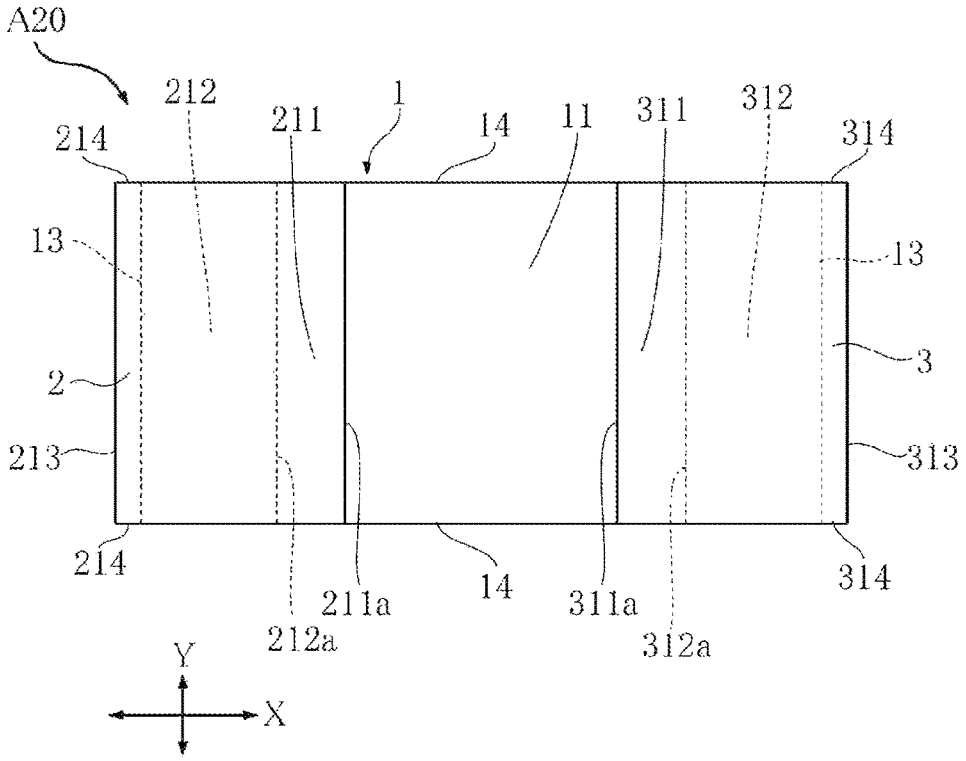
FIG. 19 is a bottom view illustrating the chip resistor of FIG. 18.
Figure 20:
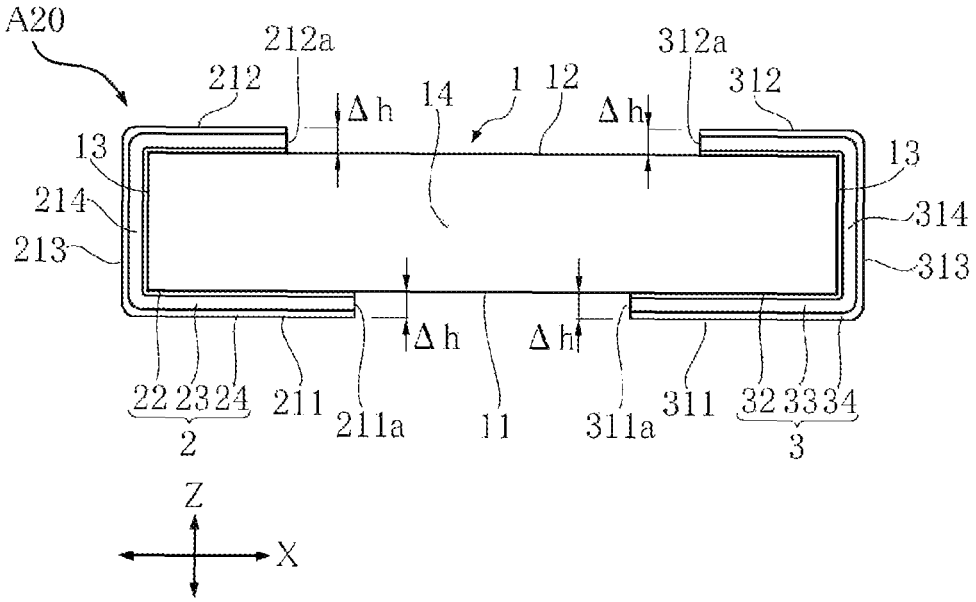
FIG. 20 is a front view illustrating the chip resistor of FIG. 18.
Figure 21:
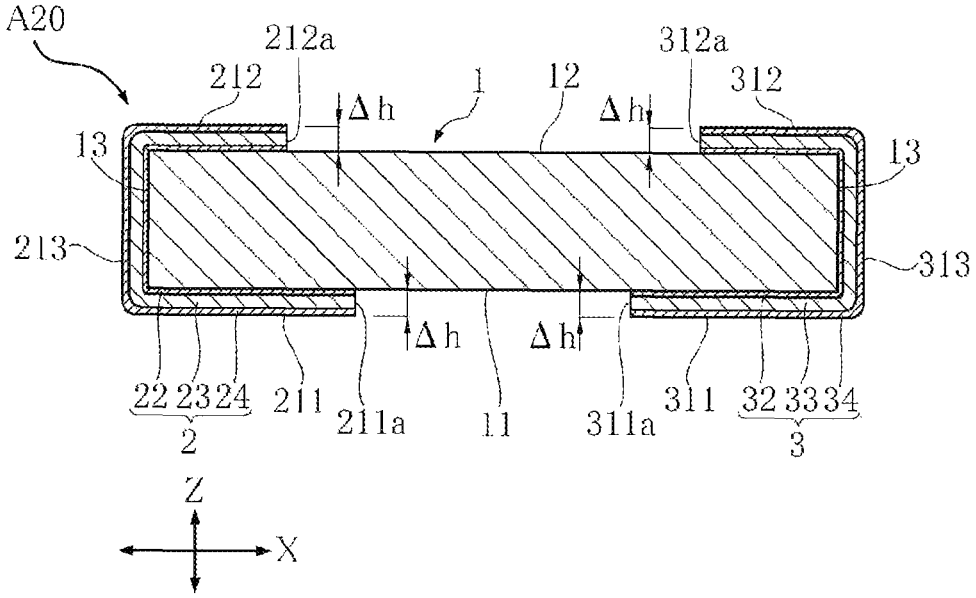
FIG. 21 is a cross-sectional view taken along line XXI-XXI of FIG. 18.
Figure 22:
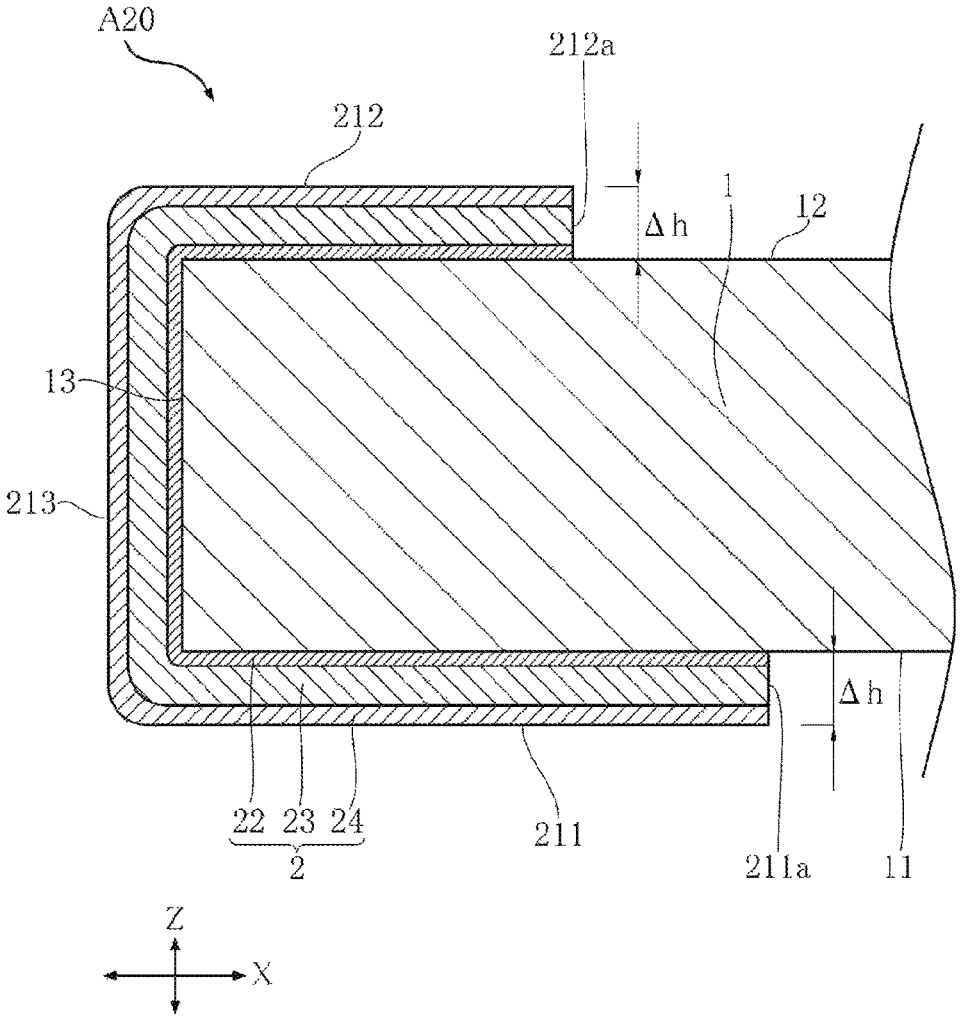
FIG. 22 is a partially enlarged view of a portion of FIG. 21.

A chip resistor A20 according to a second embodiment of the present disclosure will be described with reference to FIGS. 18 to 22. FIG. 18 is a plan view illustrating the chip resistor A20. FIG. 19 is a bottom view illustrating the chip resistor A20. FIG. 20 is a front view illustrating the chip resistor A20. FIG. 21 is a cross-sectional view taken along line XXI-XXI of FIG. 18. FIG. 22 is a partially enlarged view of a portion of FIG. 21. In this embodiment, the chip resistor A20 has a rectangular shape when viewed from a plan view.

In the chip resistor A20 of this embodiment, the shapes of the first electrode 2 and the second electrode 3 are different from those of the chip resistor A10 described above. In this embodiment, as illustrated in FIGS. 18 and 20, both the first electrode 2 and the second electrode 3 have a portion covering a portion of the resistor upper surface 12.

The first electrode 2 is one electrode of the chip resistor A20 formed along one resistor first side surface 13. As illustrated in FIGS. 20 and 21, the first electrode 2 is electrically connected with the resistor 1 by covering the portions of the resistor lower surface 11 and the resistor upper surface 12 and one resistor first surface 13. In this embodiment, the first electrode 2 has the first electrode upper surface 212 and the first electrode upper end edge 212*a*, in addition to the first electrode lower surface 211, the first electrode lower end edge 211*a*, the first electrode first side surface 213, and the pair of first electrode second side surfaces 214.

As illustrated in FIGS. 18 and 20, the first electrode upper surface 212 faces upwards, like the resistor upper surface 12. In the first direction X, an outer edge of the first electrode upper surface 212 is connected to the first electrode first side surface 213, and an inner edge of the first electrode upper surface 212 is connected to the first electrode upper end edge 212*a*. Both ends of the first electrode upper surface 212 in the second direction Y are connected to the pair of first electrode second side surfaces 214. The first electrode upper surface 212 is flat.

As illustrated in FIGS. 18 and 20, the first electrode upper end edge 212*a* is a surface extending from an inner edge of the first electrode upper surface 212 toward the resistor upper surface 12 in the thickness direction Z of the chip resistor A20. The first electrode upper end edge 212*a* is in contact with the resistor upper surface 12.

As illustrated in FIG. 20, the first electrode first side surface 213 is a surface which stands from the outer edge of the first electrode lower surface 211 upwards and is connected to the first electrode upper surface 212. The first electrode first side surface 213 faces in the first direction X.

As illustrated in FIGS. 18, 19, and 20, the pair of first electrode second side surfaces 214 are surfaces which stand from both ends of the first electrode lower surface 211 in the second direction Y and are connected to both sides of each of the first electrode upper surface 212 and the first electrode first side surface 213. The pair of first electrode second side surfaces 214 faces mutually opposite sides along the second direction Y. In this embodiment, as illustrated in FIG. 20, the first electrode second side surface 214 has a U-shape. Also, in this embodiment, as illustrated in FIGS. 18 and 19, the first electrode second side surface 214 is flush with the resistor second side surface 14.

As illustrated in FIGS. 20, 21, and 22, the first electrode 2 includes a first internal electrode 22 covering the first resistor 1, a first intermediate electrode 23 covering the first internal electrode 22, and a first external electrode 24 covering the first intermediate electrode 23. Configurations of the first internal electrode 22, the first intermediate electrode 23, and the first external electrode 24 are the same as those of the chip resistor A10.

As illustrated in FIG. 20, only the first external electrode 24 is exposed from all of the first electrode lower surface 211, the first electrode upper surface 212, and the first electrode first side surface 213 in the first electrode 2. Each of the first internal electrode 22, the first intermediate electrode 23, and the first external electrode 24 is exposed at the first electrode lower end edge 211*a*, the first electrode upper end edge 212*a*, and the pair of first electrode second side surfaces 214.

The second electrode 3 is the other electrode of the chip resistor A20 formed along the other resistor first side surface 13. As illustrated in FIGS. 20 and 21, the second electrode 3 is electrically connected with the resistor 1 by covering the portions of the resistor lower surface 11 and the resistor upper surface 12 and the other resistor first surface 13. In this embodiment, the second electrode 3 has the second electrode upper surface 312 and the second electrode upper end edge 312*a*, in addition to the second electrode lower surface 311, the second electrode lower end edge 311*a*, the second electrode first side surface 313, and the pair of second electrode second side surfaces 314. Also, in this embodiment, like the chip resistor A10, a configuration of the second electrode 3 is the same as that of the first electrode 2.

As illustrated in FIGS. 18 and 20, the second electrode upper surface 312 faces upwards, like the resistor upper surface 12. In the first direction X, an outer edge of the second electrode upper surface 312 is connected to the second electrode first side surface 313, and an inner edge of the second electrode upper surface 312 is connected to the second electrode upper end edge 312*a*. Both ends of the second electrode upper surface 312 in the second direction Y are connected to the pair of second electrode second side surfaces 314. The second electrode upper surface 312 is flat.

As illustrated in FIGS. 18 and 20, the second electrode upper end edge 312*a* is a surface extending from an inner edge of the second electrode upper surface 312 toward the resistor upper surface 12 in the thickness direction Z of the chip resistor A20. The second electrode upper end edge 312*a* is in contact with the resistor upper surface 12.

As illustrated in FIG. 20, the second electrode first side surface 313 is a surface which stands from the outer edge of the second electrode lower surface 311 upwards and is connected to the second electrode upper surface 312. The second electrode first side surface 313 faces in the first direction X.

As illustrated in FIGS. 18, 19, and 20, the pair of second electrode second side surfaces 314 are surfaces which stand from both ends of the second electrode lower surface 311 in the second direction Y and are connected to both sides of each of the second electrode upper surface 312 and the second electrode first side surface 313. The pair of second electrode second side surfaces 314 both face mutually opposite sides along the second direction Y. In this embodiment, as illustrated in FIG. 20, the second electrode second side surface 314 has a U-shape. Also, in this embodiment, as illustrated in FIGS. 18 and 19, the second electrode second side surface 314 is flush with the resistor second side surface 14. Thus, in this embodiment, the resistor second side surface 14, and the first electrode second side surface 214 and the second electrode second side surface 314 facing along the second direction Y are all flush with each other. However, like the chip resistor A10, this embodiment is not limited thereto, and for example, the first electrode second side surface 214 and the second electrode second side surface 314 may cover a portion of the resistor second side surface 14.

As illustrated in FIGS. 20 and 21, the second electrode 3 includes a second internal electrode 32 covering the first resistor 1, a second intermediate electrode 33 covering the second internal electrode 32, and a second external electrode 34 covering the second intermediate electrode 33. Configurations of the second internal electrode 32, the second intermediate electrode 33, and the second external electrode 34 are the same as those of the chip resistor A10.

As illustrated in FIG. 20, only the second external electrode 34 is exposed at all of the second electrode lower surface 311, the second electrode upper surface 312, and the second electrode first side surface 313 in the second electrode 3. Each of the second internal electrode 32, the second intermediate electrode 33, and the second external electrode 34 is exposed at the second electrode lower end edge 311*a*, the second electrode upper end edge 312*a*, and the pair of second electrode second side surfaces 314.

As illustrated in FIGS. 20 and 21, on the resistor upper surface 12, steps Δh are formed by the first electrode upper end edge 212*a* and the second electrode upper end edge 312*a*, respectively. A height of the steps Δh is equivalent to a thickness of the plated layers forming the first electrode 2 and the second electrode 3.

As illustrated in FIGS. 18 and 20, the portion of the resistor upper surface 12, which is sandwiched between the first electrode upper end edge 212*a* and the second electrode upper end edge 312*a*, is exposed. Also, as illustrated in FIG. 18, on the resistor upper surface 12, both the first electrode upper end edge 212*a* and the second electrode upper end edge 312*a* are continuously formed to extend from one resistor second side surface 14 to the other resistor second side surface 14. In this embodiment, both the first electrode upper end edge 212*a* and the second electrode upper end edge 312*a* are parallel to the second direction Y.

As illustrated in FIGS. 18, 19, and 20, in this embodiment, an exposed area of the portion of the resistor upper surface 12, which is sandwiched between the first electrode upper end edge 212*a* and the second electrode upper end edge 312*a*, is larger than that of the portion of the resistor lower surface 11, which is sandwiched between the first electrode lower end edge 211*a* and the second electrode lower end edge 311*a*.

Figure 23:
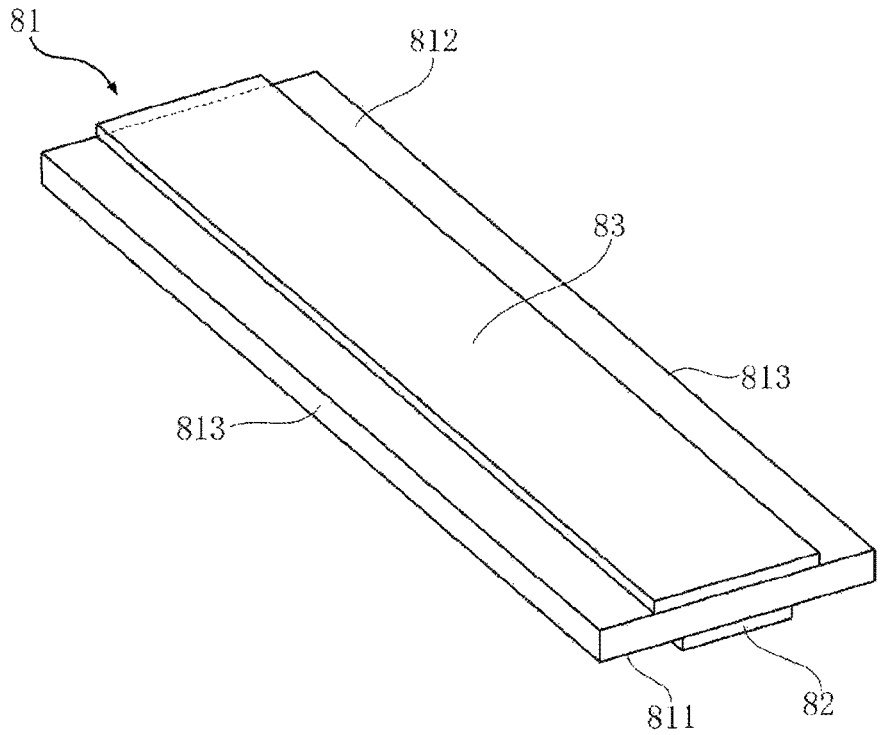
FIG. 23 is a perspective view illustrating a process of a method for manufacturing the chip resistor of FIG. 18.
Figure 24:
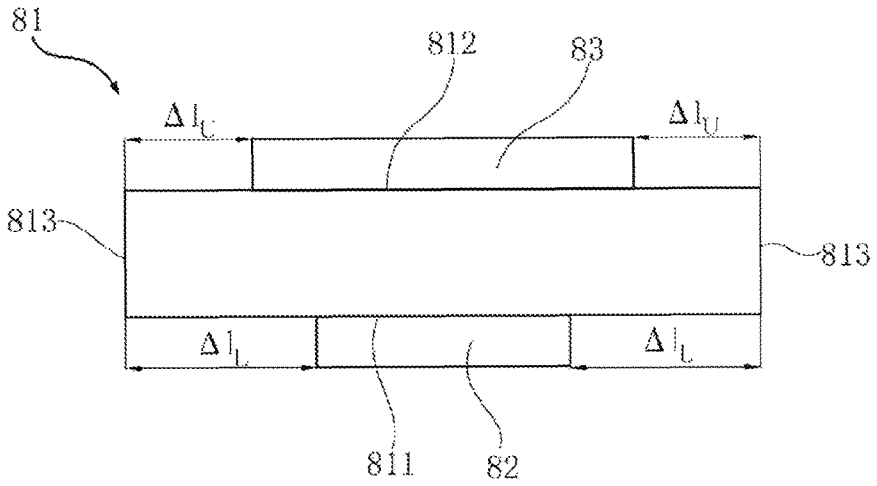
FIG. 24 is a front view illustrating a process of a method for manufacturing the chip resistor of FIG. 18.
Figure 25:
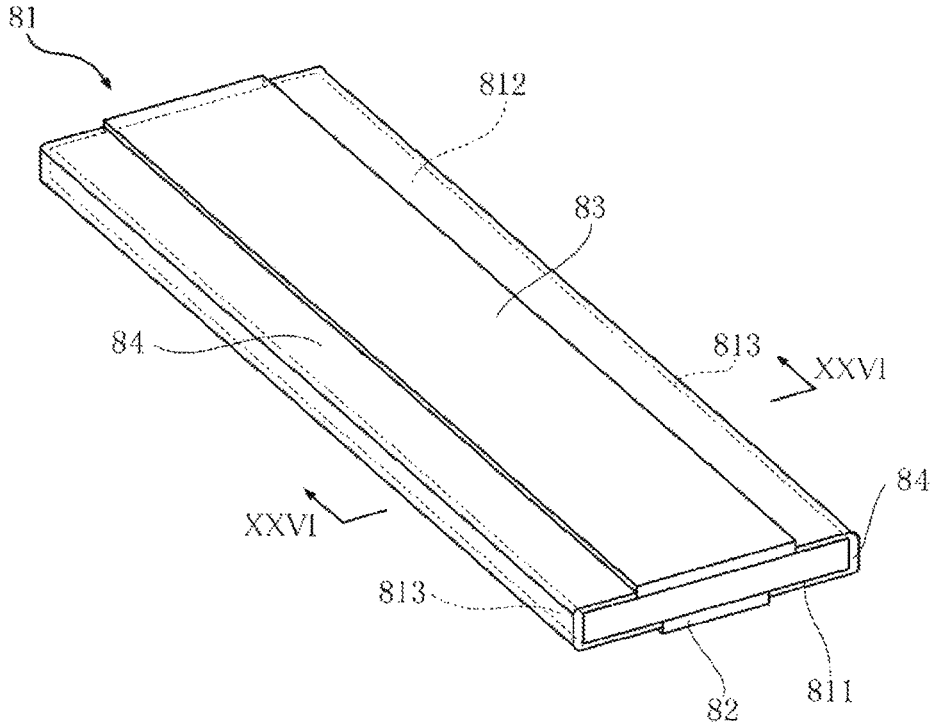
FIG. 25 is a perspective view illustrating a process of a method for manufacturing the chip resistor of FIG. 18.
Figure 26:
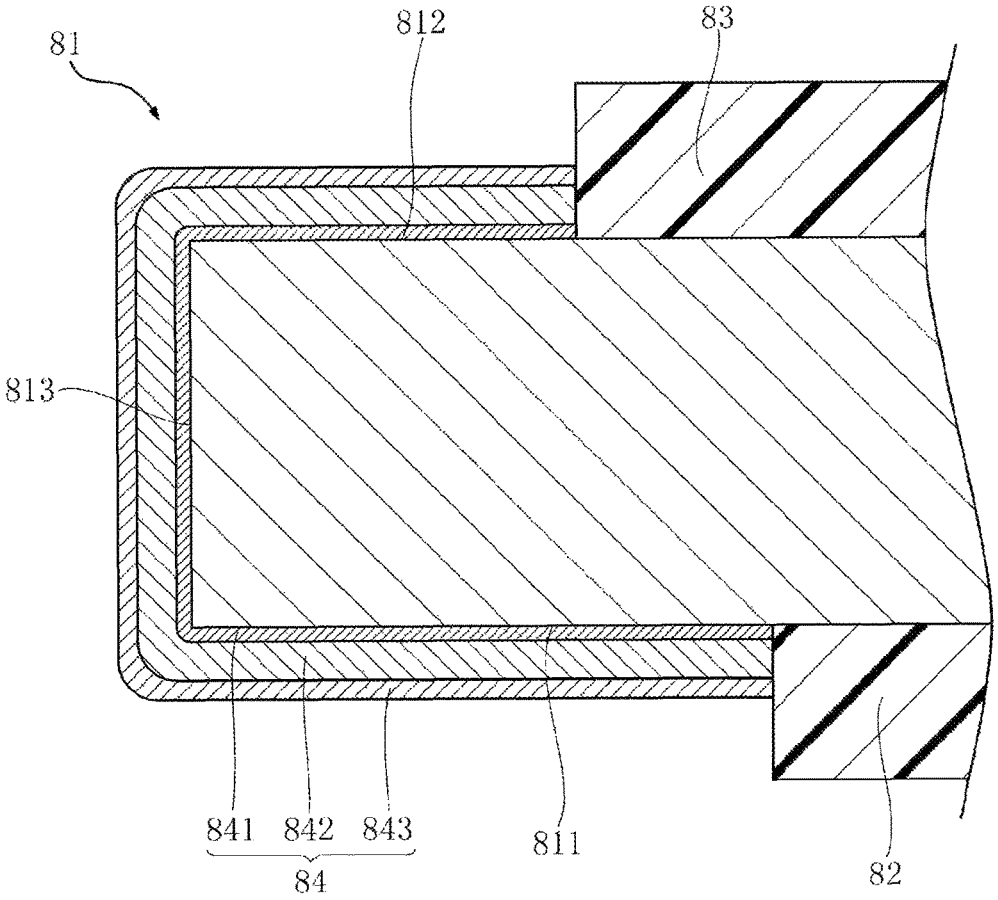
FIG. 26 is a partially enlarged cross-sectional view of a portion of a cross-section taken along line XXVI-XXVI of FIG. 25.

Next, a method for manufacturing the chip resistor A20 will be described with reference to FIGS. 23 to 26. FIGS. 23 and 25 are perspective views illustrating a process of a manufacturing method of the chip resistor A20. FIG. 24 is a front view illustrating a process of a manufacturing method of the chip resistor A20. FIG. 26 is a partially enlarged cross-sectional view of a portion of a cross-section taken along line XXVI-XXVI of FIG. 25.

First, a process of preparing the band-shaped resistor 81 is the same as the process of the manufacturing method of the chip resistor A10 illustrated in FIG. 6. And, a process of attaching the lower surface protective tape 82 to the lower surface 811 of the band-shaped resistor 81 is the same as the process of the manufacturing method of the chip resistor A10 illustrated in FIG. 7.

Subsequently, as illustrated in FIG. 23, the upper surface protective tape 83, which extends in a longitudinal direction of the band-shaped resistor 81 and also has a width smaller than that of the band-shaped resistor 81, is attached to the upper surface 812 of the band-shaped resistor 81. At this time, both end portions of the upper surface 812 in the width direction are exposed from the upper surface protective tape 83. In this embodiment, the upper surface protective tape 83 is attached to the center of the upper surface 812 in the width direction.

A state where the lower surface protective tape 82 and the upper surface protective tape 83 are each attached to the band-shaped resistor 81 is illustrated in FIG. 24. The widths $\Delta l_L$ of both end portions of the lower surface 811 exposed from the lower surface protective tape 82 in the width direction are equal to each other. Also, the widths $\Delta l_U$ of both end portions of the upper surface 812 exposed from the upper surface protective tape 83 in the width direction are equal to each other. In this embodiment, a width of the upper surface protective tape 83 used in the process of attaching the upper surface protective tape 83 is larger than that of the lower surface protective tape 82 used in the process of attaching the lower surface protective tape 82. Thus, a relation of $\Delta l_L > \Delta l_U$ is established. Further, in this embodiment, steps are formed due to the lower surface protective tape 82 and the upper surface protective tape 83 on the lower surface 811 and the upper surface 812, respectively. Also, the process of attaching the lower surface protective tape 82 and the process of attaching the upper surface protective tape 83 may also be performed in a reverse order.

Subsequently, as illustrated in FIG. 25, a pair of conductive layers 84 which conducts electricity with the band-shaped resistor 81 is formed along the pair of side surfaces 813. The pair of conductive layers 84 is formed on the portion of the band-shaped resistor 81 which is not covered by the lower surface protective tape 82 and the upper surface protective tape 83, that is, on the pair of side surfaces 813, and on both end portions of the lower surface 811 in the width direction, which are exposed from the lower surface protective tape 82, and on both end portions of the upper surface 812 in the width direction, which are exposed from the upper surface protective tape 83.

As illustrated in FIG. 26, in this embodiment, a process of forming the pair of conductive layers 84 includes a process of forming a pair of internal conductive layers 841, a process of forming a pair of intermediate conductive layers 842, and a process of forming a pair of external conductive layers 843. The process of forming the pair of internal conductive layers 841, the process of forming the pair of intermediate conductive layers 842, and the process of forming the pair of external conductive layers 843 are the same as the processes of the manufacturing method of the chip resistor A10 illustrated in FIG. 11. Also, in this embodiment, like the chip resistor A10, the pair of internal conductive layers 841 may be formed through Ni strike plating. Also, in this embodiment, a thickness of the conductive layer 84 is smaller than that of the lower surface protective tape 82 and the upper surface protective tape 83.

Subsequently, a process of detaching each of the lower surface protective tape 82 and the upper surface protective tape 83 from the band-shaped resistor 81 is the same as the process of the manufacturing method of the chip resistor A10 illustrated in FIG. 12. At this time, like the process of the manufacturing method of the chip resistor A10 illustrated in FIG. 13, the lower surface protective tape 82 may be detached from the band-shaped resistor 81, while the upper surface protective tape 83 may remain attached to the band-shaped resistor 81, rather than being detached.

Subsequently, a process of dividing the band-shaped resistor 81 into individual pieces 85 of every resistor region 810 and a process of adjusting a resistance value of each of the individual pieces 85 are the same as the processes of the manufacturing method of the chip resistor A10 illustrated in FIG. 14. Through the above processes, the chip resistor 20 is manufactured.

Also, according to this embodiment, since each of the first electrode 2 and the second electrode 3 formed of plated layers can be formed directly on the resistor 1 formed of a metal plate, it is possible to reduce the size of the chip resistor A11 using the metal plate resistor. Further, the first electrode 2 and the second electrode 3 have the first electrode upper surface 212 and the second electrode upper surface 312. With this configuration, it is possible to use the first electrode upper surface 212 and the second electrode upper surface 312, as well as the first electrode lower surface 211 and the second electrode lower surface 311, as a mounting surface of the chip resistor A20, enabling so-called bulk mounting. In this embodiment, the exposed area of the portion of the resistor upper surface 12, which is sandwiched between the first electrode upper end edge 212*a* and the second electrode upper end edge 312*a*, is larger than that of the portion of the resistor lower surface 11, which is sandwiched between the first electrode lower end edge 211*a* and the second electrode lower end edge 311*a*. With this configuration, it is possible to more easily visually determine a mounting surface to be used in implementing the chip resistor A20.

The chip resistor according to the present disclosure is not limited to the foregoing embodiments, and the like. A specific configuration of each part of the chip resistor according to the present disclosure may be modified in various ways.

According to the present disclosure in some embodiments, the first electrode and the second electrode in the chip resistor are electrically connected with the resistor by covering a portion of the resistor lower surface and the resistor first side surface, respectively. Further, the chip resistor has the first electrode lower end edge and the second lower end edge which are in contact with the resistor lower surface, and both the first electrode lower end edge and the second lower end edge in the resistor lower surface are continuously formed to extend from one resistor second side surface to the other resistor second side surface. In addition, steps are formed on the resistor lower surface by the first electrode lower end edge and the second electrode lower end edge, respectively. With this configuration, each of the first electrode and the second electrode formed of plated layers can be formed to be spaced apart from one another directly on the resistor formed of a metal layer. Thus, it is possible to reduce the size of the chip resistor using a metal plate resistor.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A chip resistor, comprising:

a resistor having a resistor lower surface and a resistor upper surface which face mutually opposite sides in a thickness direction, a pair of resistor first side surfaces spaced apart from each other in a first direction perpendicular to the thickness direction, and a pair of resistor second side surfaces spaced apart from each other in a second direction perpendicular to both the thickness direction and the first direction;

a first electrode including a side portion formed along one resistor first side surface; and a second electrode including a side portion formed along the other resistor first side surface, and spaced apart from the first electrode, wherein the first electrode and the second electrode are electrically connected with the resistor by covering a portion of the resistor lower surface and the resistor first side surfaces, respectively, upper ends of the side portions of the first electrode and the second electrode are curved, the first electrode has a first electrode lower end edge that is in contact with the resistor lower surface, the second electrode has a second electrode lower end edge that is in contact with the resistor lower surface, both the first electrode lower end edge and the second electrode lower end edge in the resistor lower surface are continuously formed to extend from one resistor second side surface to the other resistor second side surface, and steps are formed by the first electrode lower end edge and the second electrode lower end edge, respectively.

2. The chip resistor of claim 1, wherein a portion of the resistor lower surface sandwiched between the first electrode lower end edge and the second electrode lower end edge is exposed.

3. The chip resistor of claim 2, wherein the resistor second side surfaces are flush with a portion of each of the first electrode and the second electrode which face in the second direction.

4. The chip resistor of claim 2, wherein both the first electrode lower end edge and the second electrode lower end edge are parallel to the second direction.

5. The chip resistor of claim 2, wherein the resistor upper surface is entirely exposed.

6. The chip resistor of claim 5, wherein no element is formed on the resistor upper surface.

7. The chip resistor of claim 2, wherein both the first electrode and the second electrode have a portion that covers a portion of the resistor upper surface.

8. The chip resistor of claim 7, wherein the first electrode has a first electrode upper end edge that is in contact with the resistor upper surface and the second electrode has a second electrode upper end edge that is in contact with the resistor upper surface.

9. The chip resistor of claim 8, wherein a portion of the resistor upper surface sandwiched between the first electrode upper end edge and the second electrode upper end edge is exposed.

10. The chip resistor of claim 9, wherein both the first electrode upper end edge and the second electrode upper end edge are continuously formed to extend from one resistor second side surface to the other resistor second side surface in the resistor upper surface.

11. The chip resistor of claim 10, wherein both the first electrode upper end edge and the second electrode upper end edge are parallel to the second direction.

12. The chip resistor of claim 10, wherein an exposed area of the portion of the resistor upper surface surrounded by the first electrode upper end edge and the second electrode upper end edge is larger than that of the portion of the resistor lower surface surrounded by the first electrode lower end edge and the second electrode lower end edge.

13. The chip resistor of claim 1, wherein a thickness of the resistor ranges from 0.3 to 1.0 mm.

14. The chip resistor of claim 1, wherein the resistor is formed of a Ni—Cr alloy or a Cu—Mn alloy.

15. The chip resistor of claim 1, wherein four corners of the resistor second side surfaces are all at a right angle.

16. The chip resistor of claim 1, wherein four corners of the resistor second side surfaces are all curved.

17. The chip resistor of claim 1, wherein the first electrode comprises a first internal electrode covering the resistor, a first intermediate electrode covering the first internal electrode, and a first external electrode covering the first intermediate electrode, and the first internal electrode, the first intermediate electrode and the first external electrode are all formed of plated layers.

18. The chip resistor of claim 17, wherein the first external electrode is formed of a plated layer containing Sn.

19. The chip resistor of claim 17, wherein the first internal electrode is formed of a Ni plated layer.

20. The chip resistor of claim 19, wherein the first intermediate electrode is formed of a Cu plated layer.

21. The chip resistor of claim 19, wherein the first intermediate electrode comprises a first intermediate first layer covering the first internal electrode and a first intermediate second layer covering the first intermediate first layer.

22. The chip resistor of claim 21, wherein the first intermediate first layer is formed of a Cu plated layer.

23. The chip resistor of claim 21, wherein the first intermediate second layer is formed of a Ni plated layer.

24. The chip resistor of claim 17, wherein curvatures of upper ends of side portions of the first internal electrode, the first intermediate electrode and the first external electrode are different from one another.

25. The chip resistor of claim 17, wherein thicknesses of the first internal electrode, the first intermediate electrode and the first external electrode are different from one another.

26. The chip resistor of claim 17, wherein thicknesses of upper ends of side portions of the first internal electrode, the first intermediate electrode and the first external electrode are small.

27. The chip resistor of claim 1, wherein lower ends of the side portions of the first electrode and the second electrode are curved.

28. The chip resistor of claim 1, wherein thicknesses of the upper ends of the side portions of the first electrode and the second electrode are small.

* * * * *